US007746367B2

(12) United States Patent
Yamazaki

(10) Patent No.: US 7,746,367 B2
(45) Date of Patent: Jun. 29, 2010

(54) THERMAL PRINTER

(75) Inventor: Takeshi Yamazaki, Nagano (JP)

(73) Assignee: Citizen Holdings Co., Ltd., Tokyo (JP)

( * ) Notice: Subject to any disclaimer, the term of this patent is extended or adjusted under 35 U.S.C. 154(b) by 119 days.

(21) Appl. No.: 12/281,268

(22) PCT Filed: Feb. 27, 2007

(86) PCT No.: PCT/JP2007/053616

§ 371 (c)(1),
(2), (4) Date: Aug. 29, 2008

(87) PCT Pub. No.: WO2007/099940

PCT Pub. Date: Sep. 7, 2007

(65) Prior Publication Data

US 2009/0009579 A1 Jan. 8, 2009

(30) Foreign Application Priority Data

Mar. 1, 2006 (JP) ..... 2006-054607

(51) Int. Cl.
*B41J 2/36* (2006.01)

(52) U.S. Cl. ..... 347/188; 347/194

(58) Field of Classification Search ..... 347/188, 347/195, 194; 400/120.09, 120.14, 120.15
See application file for complete search history.

(56) References Cited

FOREIGN PATENT DOCUMENTS

JP 4-358853 A 12/1992
JP 7-76120 A 3/1995
JP 2002-254687 A 9/2002

OTHER PUBLICATIONS

Machine translation of JP 07-076120, published on Mar. 1995.*
International Search Report of PCT/JP2007/053616, date of mailing Mar. 27, 2007.
Notification of Transmittal of Translation of the International Preliminary Report on Patentability (Form PCT/IB/338) of International Application No. PCT/JP2007/053616 mailed Sep. 12, 2008 with Forms PCT/IB/373 and PCT/ISA/237.

* cited by examiner

*Primary Examiner*—Huan H Tran
(74) *Attorney, Agent, or Firm*—Westerman, Hattori, Daniels & Adrian, LLP

(57) ABSTRACT

The thermal printer of the present invention is a thermal printer for printing on a print medium by thermally transferring an ink ribbon by means of a thermal head, wherein the thermal printer comprises a density controller for keeping the print density of the thermal head low in low-temperature control for raising the print density at low temperatures. The density controller comprises a density calculator for calculating a density evaluation value by finding an average gradation value of print data for each of a plurality of dots included in the predetermined region, a comparator for comparing the calculated density evaluation value with a predetermined value, and an adjuster for adjusting, on the basis of this comparison result, the print density in driving and printing with the thermal head to a low value for print data of high gradation exceeding a predetermined gradation value in print data on a printed line when the density evaluation value exceeds a predetermined value. The printing of each dot by the thermal head is controlled on the basis of the adjusted print density. Even if low temperature control is carried out by the thermal head when the ambient temperature is low, the occurrence of ink ribbon wrinkling due to the effect of print density is suppressed.

19 Claims, 20 Drawing Sheets

21a
20
30a
31
30b
21b
AVERAGE DENSITY 20
30A
30B
30C
30D
30E

20 PRINT DATA

DENSITY
GRADATION

22 DENSITY DATA

| AMBIENT TEMPERATURE \ LOAD RANKING | 0 | 1 | 2 | 3 | 4 |
|---|---|---|---|---|---|
| 0.0～4.5℃ | 10/10 | 8/10 | 6/10 | 4/10 | 2/10 |
| 5.0～9.5℃ | 10/10 | 10/10 | 8/10 | 6/10 | 4/10 |
| 10.0～14.5℃ | 10/10 | 10/10 | 10/10 | 8/10 | 6/10 |
| 15.0～19.5℃ | 10/10 | 10/10 | 10/10 | 10/10 | 7/10 |
| 20.0～24.5℃ | 10/10 | 10/10 | 10/10 | 10/10 | 8/10 |
| 25.0℃～ | 10/10 | 10/10 | 10/10 | 10/10 | 8/10 |

FIG. 7

FIG. 19A
DENSITY EVALUATION

85% OR HIGHER: ○
LESS THAN 85%: ×

| P1 | P2 | P3 | P4 | P5 |
|---|---|---|---|---|
| ○ | ○ | ○ | ○ | ○ |
| ○ | ○ | ○ | ○ | ○ |
| ○ | ○ | ○ | ○ | ○ |
| ○ | ○ | ○ | ○ | ○ |
| ○ | ○ | ○ | ○ | ○ |
| ○ | ○ | ○ | ○ | ○ |
| ○ | ○ | ○ | ○ | ○ |
| ○ | ○ | ○ | ○ | ○ |
| COEFFICIENT | | | | |
| 2 | 1 | 1 | 1 | 2 |

LOAD RANKING = 2 + 1 + 1 + 1 + 2 = 7

FIG. 19B
DENSITY EVALUATION

85% OR HIGHER: ○
LESS THAN 85%: ×

| P1 | P2 | P3 | P4 | P5 |
|---|---|---|---|---|
| × | × | × | × | × |
| × | × | × | × | × |
| × | × | × | × | × |
| × | × | × | × | × |
| × | × | × | × | × |
| × | × | × | × | × |
| × | × | × | × | × |
| × | × | × | × | × |
| COEFFICIENT | | | | |
| 0 | 0 | 0 | 0 | 0 |

LOAD RANKING = 0 + 0 + 0 + 0 + 0 = 0

FIG. 19C
DENSITY EVALUATION

85% OR HIGHER: ○
LESS THAN 85%: ×

| P1 | P2 | P3 | P4 | P5 |
|---|---|---|---|---|
| ○ | ○ | ○ | ○ | ○ |
| ○ | ○ | × | ○ | ○ |
| ○ | × | × | × | ○ |
| × | ○ | ○ | ○ | ○ |
| ○ | × | ○ | × | × |
| ○ | × | ○ | ○ | × |
| ○ | ○ | × | × | ○ |
| ○ | ○ | ○ | ○ | ○ |
| COEFFICIENT | | | | |
| 2 | 0 | 1 | 0 | 2 |

LOAD RANKING = 2 + 0 + 1 + 0 + 2 = 5

FIG. 19D
DENSITY EVALUATION

85% OR HIGHER: ○
LESS THAN 85%: ×

| P1 | P2 | P3 | P4 | P5 |
|---|---|---|---|---|
| ○ | ○ | ○ | × | ○ |
| × | × | ○ | × | × |
| ○ | × | × | × | ○ |
| ○ | × | × | ○ | ○ |
| ○ | × | ○ | × | ○ |
| × | ○ | × | × | ○ |
| ○ | × | ○ | × | × |
| ○ | ○ | × | ○ | ○ |
| COEFFICIENT | | | | |
| 2 | 0 | 0 | 0 | 2 |

LOAD RANKING = 2 + 0 + 1 + 0 + 2 = 4

FIG. 20A
DENSITY EVALUATION

85% OR HIGHER: ○
LESS THAN 85%: ×

| P1 | P2 | P3 | P4 | P5 |
|---|---|---|---|---|
| ○ | ○ | ○ | × | ○ |
| × | × | ○ | × | × |
| ○ | × | × | ○ | ○ |
| ○ | × | × | ○ | × |
| ○ | × | ○ | ○ | ○ |
| × | ○ | × | × | ○ |
| ○ | × | ○ | × | × |
| ○ | ○ | × | ○ | ○ |
| COEFFICIENT | | | | |
| 2 | 0 | 0 | 1 | 0 |

LOAD RANKING = 2 + 0 + 0 + 1 + 0 = 3

FIG. 20B
DENSITY EVALUATION

85% OR HIGHER: ○
LESS THAN 85%: ×

| P1 | P2 | P3 | P4 | P5 |
|---|---|---|---|---|
| ○ | ○ | ○ | × | ○ |
| × | × | ○ | × | × |
| ○ | × | × | ○ | ○ |
| ○ | × | × | × | × |
| ○ | × | ○ | ○ | ○ |
| × | ○ | × | × | ○ |
| ○ | × | ○ | × | × |
| ○ | ○ | × | ○ | ○ |
| COEFFICIENT | | | | |
| 2 | 0 | 0 | 0 | 0 |

LOAD RANKING = 2 + 0 + 0 + 0 + 0 = 2

FIG. 20C
DENSITY EVALUATION

85% OR HIGHER: ○
LESS THAN 85%: ×

| P1 | P2 | P3 | P4 | P5 |
|---|---|---|---|---|
| ○ | ○ | ○ | ○ | ○ |
| ○ | ○ | × | ○ | × |
| × | × | × | × | ○ |
| × | ○ | ○ | ○ | ○ |
| ○ | × | ○ | × | × |
| × | × | ○ | ○ | × |
| ○ | ○ | × | × | ○ |
| ○ | ○ | ○ | ○ | ○ |
| COEFFICIENT | | | | |
| 0 | 0 | 1 | 0 | 0 |

LOAD RANKING = 0 + 0 + 1 + 0 + 0 = 1

FIG. 20D
DENSITY EVALUATION

85% OR HIGHER: ○
LESS THAN 85%: ×

| P1 | P2 | P3 | P4 | P5 |
|---|---|---|---|---|
| ○ | ○ | ○ | × | ○ |
| × | × | ○ | × | × |
| ○ | × | × | × | ○ |
| × | × | × | ○ | ○ |
| ○ | × | ○ | × | × |
| × | ○ | × | × | ○ |
| ○ | × | ○ | × | × |
| ○ | ○ | × | ○ | ○ |
| COEFFICIENT | | | | |
| 0 | 0 | 0 | 0 | 0 |

LOAD RANKING = 0 + 0 + 0 + 0 + 0 = 0

THERMAL PRINTER

TECHNICAL FIELD

This invention relates to a thermal printer that performs printing by the thermal transfer of an ink ribbon, and more particularly relates to a thermal printer that prevents wrinkling of the ink ribbon, which is caused by the heat generated by the thermal head.

BACKGROUND

A thermal transfer printer performs printing by using a thermal head to heat a predetermined portion of an ink ribbon coated with a molten ink or a sublimation dye, and thermally transferring the ink to printing paper. Because this thermal head transfers the ink by generating heat, heat accumulates in the head over the course of printing. The temperature of the thermal head is determined by the balance between this heat accumulation and heat radiation. Therefore, if more heat accumulates than is radiated, the temperature of the thermal head will steadily rise. When the temperature of the thermal head rises, then even if a print command is issued for a given print density, the density at which the thermal head actually prints will end up being higher than the print density when the thermal head is cooler.

In view of this, in Patent Document 1 is disclosed a method for powering a thermal head in which the optimal printing energy is calculated while the temperature of any heat generating member is measured.

Meanwhile, when the temperature around the printer is low, the overall print density will be lower, so there is also a known printer that detects the ambient temperature and adjusts the print density.

Also, with a thermal printer that makes use of an ink ribbon, a problem has been indicated whereby the ink ribbon shrinks in some places due to heating of the thermal head, and this creates wrinkles in the ink ribbon and diminishes print quality (see Patent Document 2).

This Patent Document 2 cites as prior art that with a label printer, which uses a thermal head to print on rolled label paper in which labels are affixed at regular intervals to a base paper, to prevent the ink ribbon from becoming wrinkled, the conveyance speed of the ink ribbon is matched to the conveyance speed of the paper, the winding diameter of the winder shaft, and the winding diameter of the ink ribbon feed shaft, and a suitable torque is applied to the motor that drives the feed shaft and winder shaft according to this conveyance speed, thereby achieving the proper tension of the ink ribbon.

Patent Document 2 also indicates that since more of the ink ribbon will shrink with a printed image having a large printed surface area that has to be heated, wrinkling happens at the boundary between the portions heated by the thermal head and portions not heated, and it is difficult to eliminate wrinkles merely by adjusting the ink ribbon to the proper tension by optimizing the torque applied to the motor that drives the feed shaft and winder shaft. It is also stated that when the original image has a continuous pattern, in a homogeneous pattern is continuously laid out in the lateral width direction, if the original image of this continuous pattern is written to a drawing memory so as to be printed past the ends of the print medium, the boundary between the heated portions and unheated portions will be away from the print medium, and the places on the thermal transfer ink member where wrinkling occurs will be away from the print medium, thereby eliminating the effect of the wrinkles.

Patent Document 1: Japanese Laid-Open Patent Application H4-358853

Patent Document 2: Japanese Laid-Open Patent Application 2002-254687

In Patent Document 2 mentioned above, the boundary between the heated and unheated portions is moved away from the print medium, which moves the places where wrinkles form on the thermal transfer ink member away from the print medium, and this is supposed to keep wrinkles from forming and eliminate the effect of wrinkles, but a continuous pattern in which a homogeneous pattern is continuously laid out in the lateral width direction needs to be present in the original image, so a problem is that this approach cannot be applied if no such continuous pattern is present in the original image.

Also, reducing the energy supplied to the thermal head is expected to suppress wrinkling of the ink ribbon caused by the heating of the thermal head. However, when the ambient temperature is low, in order to keep the overall print density from being low, print density adjustment is performed in which the print density is controlled in the direction of being raised, and this adjustment is in the opposite control direction from that of control in which the wrinkling of the ink ribbon is suppressed, so a problem is that this approach cannot be applied when the ambient temperature is low.

DISCLOSURE OF THE INVENTION

In view of this, it is an object of the present invention to solve the above-mentioned problems so that even when the ambient temperature is low, and when the thermal head performs low-temperature control, the occurrence of ink ribbon wrinkling due to the effect of print density will be suppressed.

It is another object to suppress wrinkling of the ink ribbon due the effect of print density, without having to use a special pattern for the original image.

The thermal printer of the present invention is a thermal printer for printing on a print medium by thermally transferring an ink ribbon by means of a thermal head, wherein the thermal printer comprises a density controller for keeping the print density of the thermal head low in low-temperature control for raising the print density at low temperatures.

During printing, the density controller calculates a density evaluation value on the basis of the density of print data within predetermined regions that were printed prior to the current printing. This density evaluation value is an index for evaluating how likely it is that the ink ribbon will become wrinkled. Since the heating state of the thermal head reflects the print data used in printing, the heating state of the thermal head can be assessed from this density evaluation value.

Also, in calculating the density evaluation value, rather than using the entire print data for calculation, if just the print data in a selected predetermined region is used, it will be possible to select just the print data that is closely related to wrinkling of the ink ribbon, and the amount of data processing can also be reduced.

When the calculated density evaluation value exceeds a predetermined value, it is determined that if this print data is used to perform printing, the increased temperature of the thermal head will cause the ink ribbon to wrinkle. Furthermore, the drive of the thermal head is controlled to reduce wrinkling of the ink ribbon on the basis of this determination. In this control, just the portions of high density is controlled, rather than lower the print density for all of the print data. With this density control, the print density of the thermal head is lowered for just the portions of high density that exceed a predetermined density. This avoids the problem of diminished print density for the entire printed image.

With the thermal printer of the present invention, adjusting the print density of the thermal head to be low can be accomplished by a first mode and a second mode in low-temperature control for raising the print density at low temperatures.

The first mode here is one in which whether wrinkling has occurred is determined from the density state at both ends in the printing width direction of the thermal head, and density evaluation and control of the print density based on this density evaluation are carried out for every printed line.

The second mode is one in which whether wrinkling has occurred is determined from the density state at both ends in the printing width direction of the thermal head and at the inside part sandwiched between these two ends, and density evaluation and control of the print density based on this density evaluation are carried out for each printed image.

With a thermal printer of the first mode, the predetermined region is a print data portion from before the print line where current printing is to be conducted, and this print data portion is a region set at both ends in the printing width direction, in the portion that has already undergone print processing. The reason this predetermined region is set at both ends in the printing width direction is that this region contributes more to the wrinkling of the ink ribbon than does the middle portion in the printing width direction.

This predetermined region can, for example, be such that it includes print data of m×n dots in one region, where the m dots are in the printing width direction and the n dots are in the paper feed direction.

The density controller in the first mode comprises a density calculator for calculating a density evaluation value by finding an average gradation value of print data for each of a plurality of dots included in the predetermined region, a comparator for comparing the calculated density evaluation value with a predetermined value, and an adjuster for adjusting, on the basis of this comparison result, the print density in driving and printing with the thermal head to a low value for print data of high gradation exceeding a predetermined gradation value in print data on a printed line when the density evaluation value exceeds a predetermined value. The printing of each dot by the thermal head is controlled on the basis of the adjusted print density.

The calculation processing for the density evaluation value performed by the above-mentioned density calculator is shown for printing a single sheet in one color, but can also be applied to printing multiple sheets and to multicolor printing.

In multicolor printing with ink ribbons of a plurality of colors, the density calculator in the first mode calculates the density evaluation value for print data of a current printing color by adding a value obtained by weighting a density evaluation value calculated for a printing color prior to the current printing color, to a value obtained by finding the average gradation value of print data for each of a plurality of dots included in the predetermined region, as discussed above.

This weighting can be determined according to the order in which the colors are printed, or can be set to a value that becomes smaller as the elapsed time with the current printing color becomes greater, or can be determined according to the elapsed time.

Also, in continuous printing of a plurality of sheets, the density calculator in the first mode calculates the density evaluation value for current print data by adding a value obtained by weighting a density evaluation value calculated for the printing prior to the current printing, to a value obtained by finding the average gradation value of print data for each of a plurality of dots included in the predetermined region, as discussed above, for current print data in the continuous printing of a plurality of sheets.

This weighting can be determined according to a past printing state, or can be set to a value that becomes smaller as the elapsed time with the current printing becomes greater, or can be determined according to the elapsed time.

The adjuster in the first mode adjusts the print density to a low value by decreasing the print density of the thermal head by a predetermined proportion with respect to a gradation value between 85% and 100% of the total gradation width for the gradation value of each dot when the gradation value of the dots on the printed line is a high gradation value that exceeds 85% of a total gradation range, for example. When the print density is adjusted lower over a range of high gradation, this reduces excess heating of the thermal head and suppresses the wrinkling of the ink ribbon. A gradation value of 85% that determines the range of high gradation is just an example, and the present invention is not limited to this gradation value.

The adjustment performed by the adjuster can be a mode in which the slope of the print density with respect to the gradation value is subjected to linear adjustment at a slope of less than 1, or a mode in which the print density with respect to the gradation value is subjected to curve adjustment with a two-dimensional curve having a predetermined decreasing slope characteristic.

In the mode of linear adjustment, the slope subjected to linear adjustment can be set according to an ambient temperature. The relationship between the ambient temperature and the slope of the print density with respect to the gradation value is a positive relationship, and the slope of the print density with respect to the gradation value is set smaller as the ambient temperature becomes lower.

The phrase "positive relationship between the ambient temperature and the slope of the print density with respect to the gradation value" here means that when the ambient temperature rises, the slope of the print density with respect to the gradation value increases, and when the ambient temperature falls, the slope of the print density with respect to the gradation value decreases. This slope of the print density with respect to the gradation value is a slope whose maximum is less than 1, and even if the ambient temperature should rise high, the density is not set higher than the print density that is set initially.

Next, with the thermal printer of the second mode, the predetermined region is a reed shaped region that is set at the two ends in the printing width direction and at least one middle part sandwiched between the two ends, and that extends in a paper feed direction. This region is a print data portion from before the printed image where current printing is to be conducted, and this print data portion is a region set at both ends in the printing width direction and in between these two ends, out of the printed image that has already undergone print processing. The reason this predetermined region is set at both ends in the printing width direction and in between these two ends is to acquire the state of contribution to ink ribbon wrinkling from the entire printed image. Also, weighting these reed shaped portions makes it possible to fix the proportion by which they contribute to ink ribbon wrinkling, and allows the contribution to wrinkling of the ink ribbon at the two ends to be set high, and the contribution of the middle portion in the printing width direction to be set low.

The density controller in the second mode comprises a density calculator for calculating a density evaluation value by finding an average gradation value of print data for each of a plurality of dots included in the predetermined region, a comparator for comparing the density evaluation value with a predetermined value, and an adjuster for adjusting, on the basis of this comparison result, the print density of the thermal head to a low value for print data of high gradation exceeding a predetermined gradation value in print data for a single printed image when the density evaluation value exceeds a predetermined value. The printing of each dot by the thermal head is controlled on the basis of the adjusted print density.

The density calculator in the second mode finds the average gradation value for print data of a plurality of dots selected from the reed shaped regions from out of the plurality of dots included in the predetermined region, assigns a weighting coefficient to each reed shaped region in the paper feed direction on the basis of the average value, and calculates the density evaluation value with respect to the entire printed image from the sum of these weighting coefficients.

The selection of dots from the reed shaped regions can be accomplished, for example, by selecting a plurality of dots lined up continuously in the printing width direction for every predetermined number of lines in the paper feed direction. For instance, 10 dots can be selected every 20 lines. The value obtained by averaging the gradation value of the print data for a plurality of selected dots is taken as the gradation value for that selection point.

The weighting coefficients fix the proportion by which each reed shaped region contributes to the density evaluation value of a single printed image. The density evaluation value can be determined according to the proportion by which heat from the thermal head contributes to the wrinkling of the ink ribbon by setting a high weighting coefficient for the reed shaped regions located at the two ends in the printing width direction, and setting a low weighting coefficient for the reed shaped region located in the middle and in between the two ends in the printing width direction.

The density calculator assigns the weighting coefficient preset to the reed shaped region when, in the array of average values included in the reed shaped regions in the paper feed direction, the number of continuous selection points at which this average value exceeds a predetermined value is equal to or greater than a predetermined proportion with respect to the number of selection points included in the paper feed direction, and a weighting coefficient is assigned to each reed shaped region by giving a coefficient of 0 to this reed shaped region when the number of continuous selection points at which the average value exceeds a predetermined value does not exceed the predetermined proportion with respect to the number of selection points included in the paper feed direction.

As discussed above, the density evaluation value for the entire printed image is calculated by summing these weighting coefficients.

The calculation processing for the density evaluation value performed by the above-mentioned density calculator is shown for printing a single sheet in one color, but can also be applied to printing multiple sheets and to multicolor printing in the same manner as in the first mode.

In the multicolor printing with ink ribbons of a plurality of colors, the density calculator in the second mode calculates the density evaluation value for print data of a current printing color by adding a value obtained by weighting a density evaluation value calculated for a printing color prior to the current printing color, to a value obtained by finding the average gradation value of print data for each of a plurality of dots included in the predetermined region, as discussed above.

This weighting can be determined according to the order in which the colors are printed, or can be set to a value that becomes smaller as the elapsed time with the current printing color becomes greater, or can be determined according to the elapsed time.

Also, in the continuous printing of a plurality of sheets, the density calculator in the second mode calculates the density evaluation value for current print data by adding a value obtained by a density evaluation value calculated for the printing prior to the current printing, to a value obtained by finding the average gradation value of print data for each of a plurality of dots included in the predetermined region, as discussed above, for current print data in the continuous printing of a plurality of sheets.

This weighting can be determined according to a past printing state, or can be set to a value that becomes smaller as the elapsed time with the current printing becomes greater, or can be determined according to the elapsed time.

Just as with the first mode discussed above, the adjuster in the second mode adjusts the print density to a low value by decreasing the print density of the thermal head by a predetermined proportion with respect to a gradation value between 85% and 100% of the total gradation width for the gradation value of each dot when the gradation value of the dots on a printed line is a high gradation value that exceeds 85% of a total gradation range. When the print density is adjusted lower over a range of high gradation, this reduces excess heating of the thermal head and suppresses the wrinkling of the ink ribbon. A gradation value of 85% that determines the range of high gradation is just an example, and the present invention is not limited to this gradation value.

The adjustment performed by the adjuster can be a mode in which the slope of the print density with respect to the gradation value is subjected to linear adjustment at a slope of less than 1, or a mode in which the print density with respect to the gradation value is subjected to curve adjustment with a two-dimensional curve having a predetermined decreasing slope characteristic.

In the mode of linear adjustment, the slope subjected to linear adjustment can be set according to the ambient temperature. The relationship between the ambient temperature and the slope of the print density with respect to the gradation value is a positive relationship, and the slope of the print density with respect to the gradation value is set smaller as the ambient temperature becomes lower.

The phrase "positive relationship between the ambient temperature and the slope of the print density with respect to the gradation value" here means that when the ambient temperature rises, the slope of the print density with respect to the gradation value increases, and when the ambient temperature falls, the slope of the print density with respect to the gradation value decreases. This slope of the print density with respect to the gradation value is a slope whose maximum is less than 1, and even if the ambient temperature should rise high, the density is not set higher than the print density that is set initially.

With the thermal printer of the present invention, when the ambient temperature is low, and when the thermal head performs low-temperature control, the occurrence of ink ribbon wrinkling due to the effect of print density will be suppressed.

Also, with the thermal printer of the present invention, wrinkling of the ink ribbon due the effect of print density can be suppressed without having to use a special pattern for the original image, in which a continuous pattern in which a homogeneous pattern is continuously laid out in the lateral width direction.

BRIEF DESCRIPTION OF THE DRAWINGS

FIG. 7 is a table showing examples of the slope of density adjustment in the first mode of the present invention;

FIGS. 19A-19D illustrates examples of the array of the comparison results in the second mode of the present invention; and FIGS. 20A-20D illustrates examples of the array of the comparison results in the second mode of the present invention.

Figures 1A, 1B, 1C, 1D, 1E:
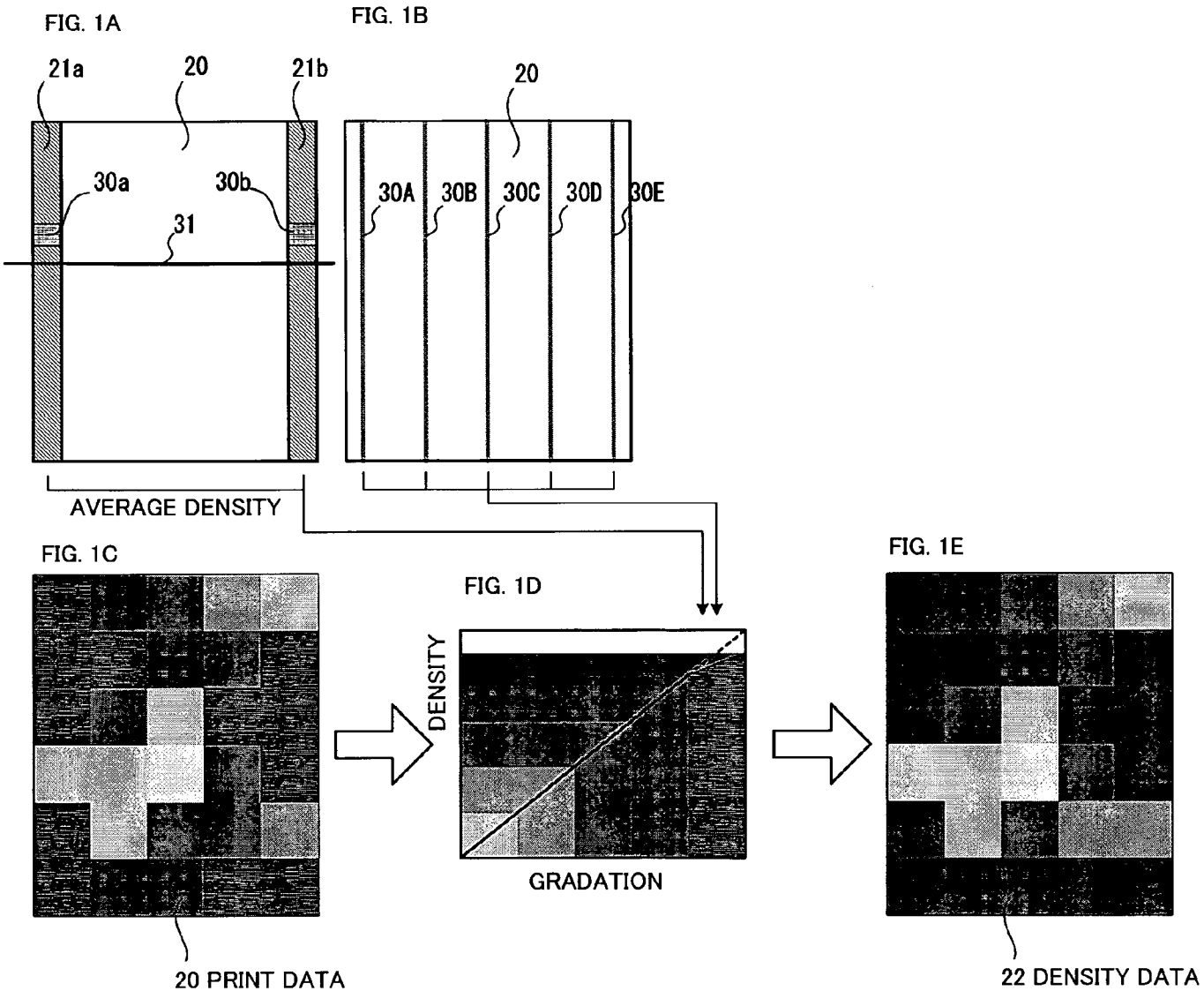
FIGS. 1A-1E illustrates the processing for density adjustment by the thermal printer of the present invention.

1 thermal printer
2 thermal head
3 head driver
4 ink ribbon
5 printer paper
5*a*, 5*b* ends
11 printing controller
12 memory
12*a* image data
12*b* print data
12*c* history data
13 print data formation component
14 density controller
15 temperature controller
16 temperature sensor
17 paper feed controller
18 ribbon feed controller
20 print data
21*a*, 21*b* ends
30*a*, 30*b*, 30A to 30E predetermined regions
31 printed line

BEST MODE FOR CARRYING OUT THE INVENTION

A mode of the thermal printer of the present invention will now be described through reference to FIGS. 1 to 20.

FIG. 1 is a simplified diagram illustrating the processing for density adjustment by the thermal printer of the present invention. FIG. 1 shows first and second modes of the thermal printer of the present invention.

With the thermal printer of the present invention, wrinkling of the ink ribbon is suppressed by adjusting the print density of the thermal head in low-temperature control for raising the print density at low temperatures. In the first mode, the occurrence of wrinkling is evaluated according to the density state at both ends in the printing width direction of the thermal head, and both density evaluation and control of print density based on this density evaluation are performed for every printed line. In the second mode, the occurrence of wrinkling is evaluated according to the density state at both ends in the printing width direction of the thermal head, and on the inside sandwiched between the two ends, and both density evaluation and control of print density based on this density evaluation are performed for every printed image.

FIG. 1C schematically illustrates print data prior to adjustment, and FIG. 1E schematically illustrates density data obtained by adjusting the print data. In FIG. 1, portions of high density are shown darker, and portions of low density are shown lighter.

With the density data after adjustment shown in FIG. 1E, the occurrence of ink ribbon wrinkling is suppressed by reducing heating of the thermal head by reducing the high-density portion where it is likely that the temperature of the thermal head will be high. Conversion from this print data to density data is accomplished using a gamma table (FIG. 1D) in which the relationship between gradation and density is determined.

The thermal printer of the present invention is such that the reduction of density in the high-density portions is performed by adjusting the relationship of density to gradation for high-gradation portions in this gamma table. This adjustment can be performed as linear adjustment, in which the slope of the print density with respect to gradation is adjusted, as well as curve adjustment, in which the curve of density with respect to gradation is adjusted.

With the thermal printer of the present invention, determining whether or not to perform density adjustment from the above-mentioned gamma table, and deciding the extent of adjustment in the density adjustment, are performed by computing the density state using print data that has already undergone print processing, and estimating the temperature of the thermal head from this density state. Whether or not the ink ribbon will wrinkle is determined by the temperature reached by heating in the past, and by heating produced by the current printing. With the present invention, the heating temperature reached by past printing is estimated from the print data used in the previous printing rather than the current printing, and if this temperature indicates that it the ink ribbon is likely to become wrinkled, then density adjustment is performed for the current print data as discussed above, which reduces the increase in temperature of the thermal head and suppresses wrinkling of the ink ribbon.

Estimating the heating state produced by past printing can be accomplished by using a density evaluation value calculated using gradation data included in the print data used in printing prior to the current printing.

With the thermal printer of the present invention, this density evaluation value can be found by a first mode in which the density state is evaluated at both ends in the printing width direction of the thermal head, or by a second mode in which the density state is evaluated on the inside part sandwiched between the two ends. FIG. 1A illustrates the first mode, and FIG. 1B the second mode.

With the first mode shown in FIG. 1A, out of all the print data 20, for the print data corresponding to the two ends 21*a* and 21*b* in the printing width direction when the thermal head is printing, print data is selected for the predetermined regions 30*a* and 30*b* used in printing prior to the printed line 31 on which the current printing is performed, and the density evaluation value is calculated from the print data included in these predetermined regions 30*a* and 30*b*.

This density evaluation value can be acquired by computing the average gradation value for each of the dots in the predetermined regions 30*a* and 30*b*.

With the second mode shown in FIG. 1B, out of all the print data of the printed image used in printing prior to the printed image on which the current printing is performed, the density evaluation value is calculated from the print data included in each of the predetermined regions 30A to 30E for the print data corresponding to the reed shaped regions 30A to 30E extending in the paper feed direction and set at the two ends to at least one middle part sandwiched between these two ends in the printing width direction when the thermal head is printing.

To find this density evaluation value, for example, a printed line is selected at a predetermined interval from the dots in the predetermined regions 30A to 30E, and the density state of the reed shaped regions is found by calculating the average gradation value of a predetermined number of dots that are continuous within this printed line. Furthermore, whether or not to weight this density evaluation value is determined by comparing the density of the reed shaped regions with a threshold value for each reed shaped region, and if weighting is to be performed, it is set ahead of time for each reed shaped region and a weighting coefficient is assigned. Further, a weighting coefficient is added to each reed shaped region, and the density evaluation value is calculated for print data of a single image.

Density adjustment is performed in conversion from print data (gradation) to density as discussed above, on the basis of the density evaluation value calculated in the above-mentioned first mode (the example shown in FIG. 1A) or the second mode (the example shown in FIG. 1B).

Figure 2:
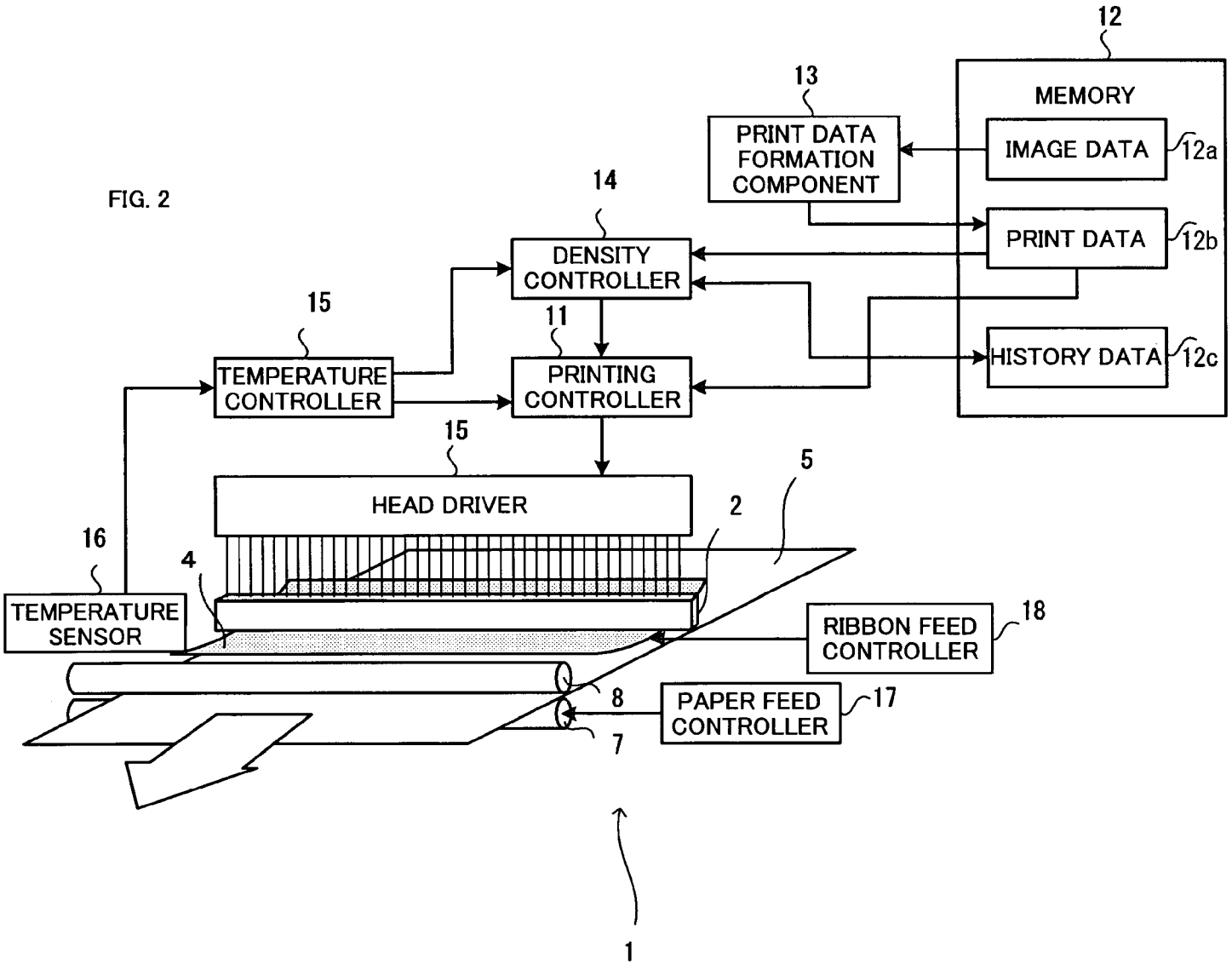
FIG. 2 is a simplified configuration diagram of the thermal printer of the present invention.

FIG. 2 is a simplified configuration diagram of the thermal printer of the present invention. In FIG. 2, a thermal printer 1 is similar in configuration to that of an ordinary thermal printer in that it comprises a thermal head 2 in which heads are arranged in a line for performing printing by dots, a head driver 3 for driving this thermal head 2 in head units, an ink ribbon 4 that is squeezed between the thermal head 2 and printer paper 5 and transfers ink to the printer paper 5 by means of the heat from the thermal head 2, a paper feed roller 7 that conveys the printer paper 5 in the paper feed direction, a platen roller 8 that squeezes the printer paper 5 between itself and the paper feed roller 7, a paper feed controller 17 that controls the drive of the paper feed roller 7, and an ink ribbon controller 18 that conveys the ink ribbon 4. The head driver 3, the paper feed controller 17, the ink ribbon controller 18, and other such control components are controlled by a print controller 11.

A temperature controller 15 is also provided, and temperature control is performed on the basis of the ambient temperature detected by a temperature sensor 16, which detects the ambient temperature of the surroundings. In this temperature control, the print density is raised whenever the ambient temperature drops below a predetermined temperature.

The thermal printer 1 is also equipped with a print data formation component 13, which forms print data 12*b* from image data 12*a* inputted from the outside. The print data 12*b* is data for performing printing with the thermal head by driving the head driver 3. The image data 12*a* and the print data 12*b* are stored in a memory 12. Here, the print data 12*b* is used in one-line units or units of several lines, for example, for print processing, so a RAM or other such temporary storage means can be used.

With an ordinary thermal printer, the print controller 11 reads the print data 12*b* from the memory 12, the head driver 3 switches the dots to be printed out of all the dots of the thermal head 2, and drive current is supplied according to the print density.

With the thermal printer 1 of the present invention, in addition to the configuration had by the above-mentioned ordinary thermal printer, a means for performing density adjustment is also provided. The thermal printer 1 of the present invention is equipped with a density controller 14 as the means for performing density adjustment, and print data used in past printing is stored as history data 12*c* in the memory 12.

The density controller 14 reads the print data used in the printing prior to the current printing as the history data 12*c*, calculates the above-mentioned density evaluation value that estimates the temperature state of the thermal head, and determines whether or not to perform density adjustment on the basis of this density evaluation value. If density adjustment is to be performed, print data for the current printing is read from the print data 12*b*, density adjustment is performed in dot units, and the density of printing performed by the print controller 11 is adjusted.

The various components discussed above can be controlled by being connected to a bus (not shown) that is connected to a CPU (not shown) that performs overall control of the components, and various control programs stored in the ROM (not shown) or other storage means can be executed. Also, a RAM (not shown) is connected to the bus, and is used to store image data, print data, or history data, as well as for the temporary storage of other processing data.

Next, an example of the first mode of the present invention will be described through reference to FIGS. 3 to 10. In the first mode, wrinkling is evaluated from the density state of the two ends in the printing width direction of the thermal head, and density evaluation control of the print density on the basis of this density evaluation are performed for every printed line.

FIG. 3 is a diagram illustrating the predetermined regions 30*a* and 30*b* for evaluating the density state in the first mode.

Figure 3A:
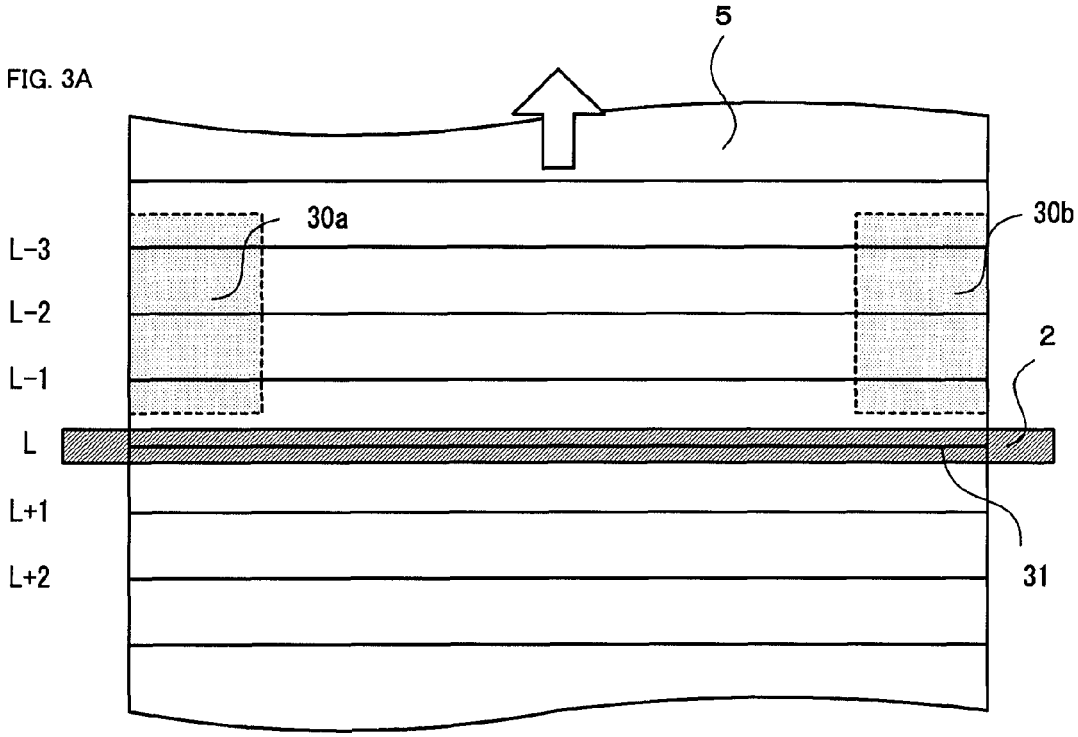
FIGS. 3A-3B illustrates the predetermined region for evaluating the density state in the first mode of the present invention.

FIG. 3A shows a state in which the thermal head 2 is printing the L-th printed line 31. Here, the predetermined regions 30*a* and 30*b* are set in order to acquire print data corresponding to the end portions in printing on printer paper, which is the print data used in printing prior to the printed line 31. FIG. 3A shows an example in which three lines (L−1, L−2, and L−3) are used for the predetermined regions 30*a* and 30*b*. The print density is evaluated on the basis of the print data included in these predetermined regions 30*a* and 30*b*. When the thermal head is driven, the more current is supplied as the print density becomes higher, and this increases the temperature, so the temperature state of the thermal head is estimated from the print density.

Figure 3B:
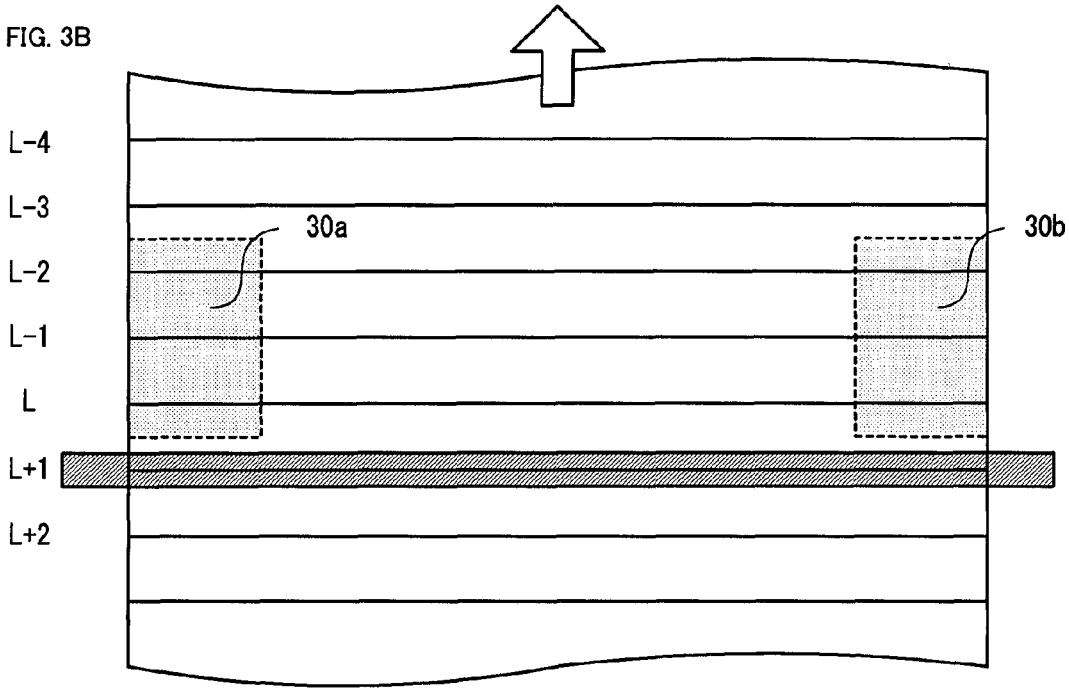

FIG. 3B shows a state in which paper feed by one line has been performed from the state in FIG. 3A, and printing is performed with the next line L+1 as the printed line. Here, the predetermined regions 30*a* and 30*b* are selected at the end portions for three lines (L, L−1 and L−2), and the print density is evaluated on the basis of the print data included in these predetermined regions 30*a* and 30*b*.

Then, every time a line is printed, the predetermined regions 30*a* and 30*b* are set in order, and the print density is evaluated.

Figure 4:
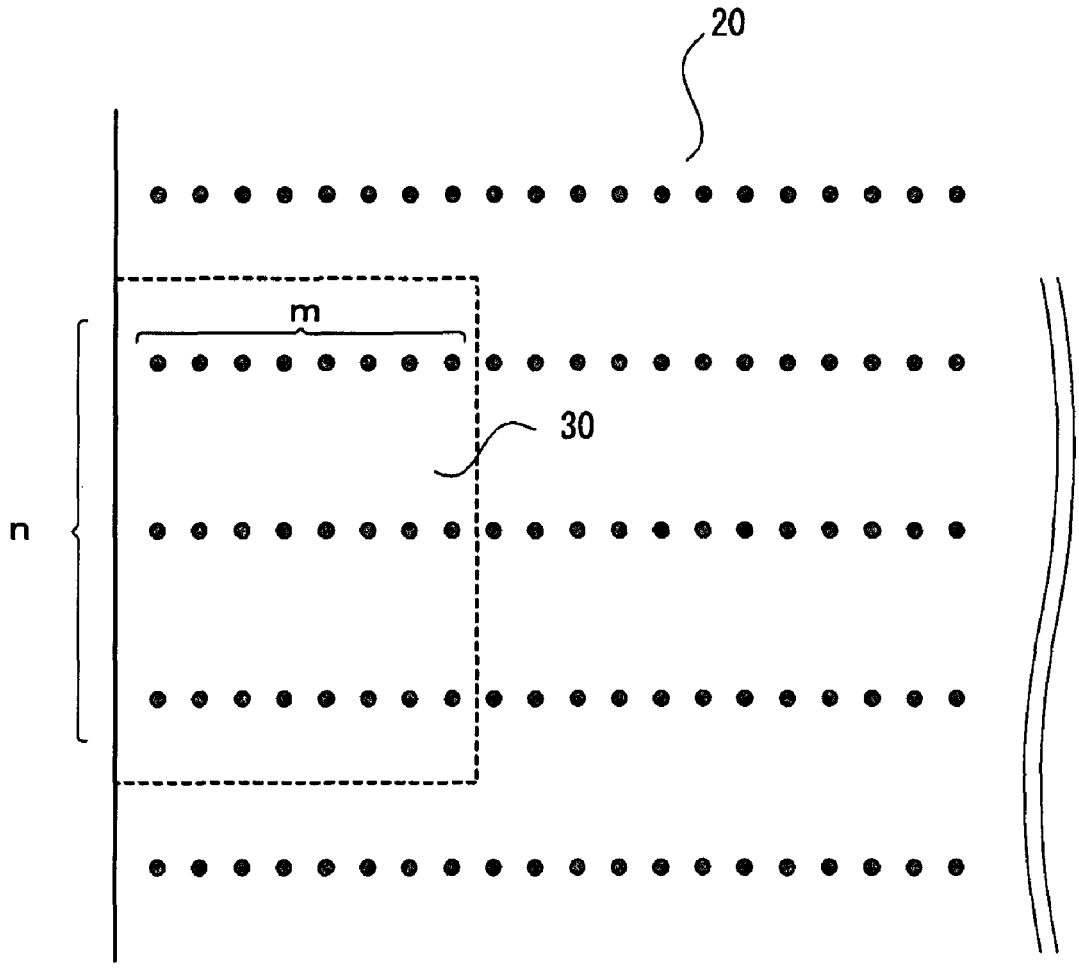
FIG. 4 is a diagram of an example of the predetermined region in the first mode of the present invention.

FIG. 4 shows an example of the above-mentioned predetermined region 30. This predetermined region 30 is set to a region measuring m dots in the printing width direction of the thermal head and n dots in the paper feed direction, and a total of m×n dots are included. Gradation is determined for each of the dots as print data, drive current corresponding to this gradation is supplied from the head driver to the heating element provided for each dot, and the ink ribbon is subjected to thermal transfer according to the density.

FIGS. 3 and 4 show an example of m×n dots included in three lines as the predetermined region 30 (30*a*, 30*b*), but the size of this region is merely an example, and the size is not limited to this.

Figure 5:
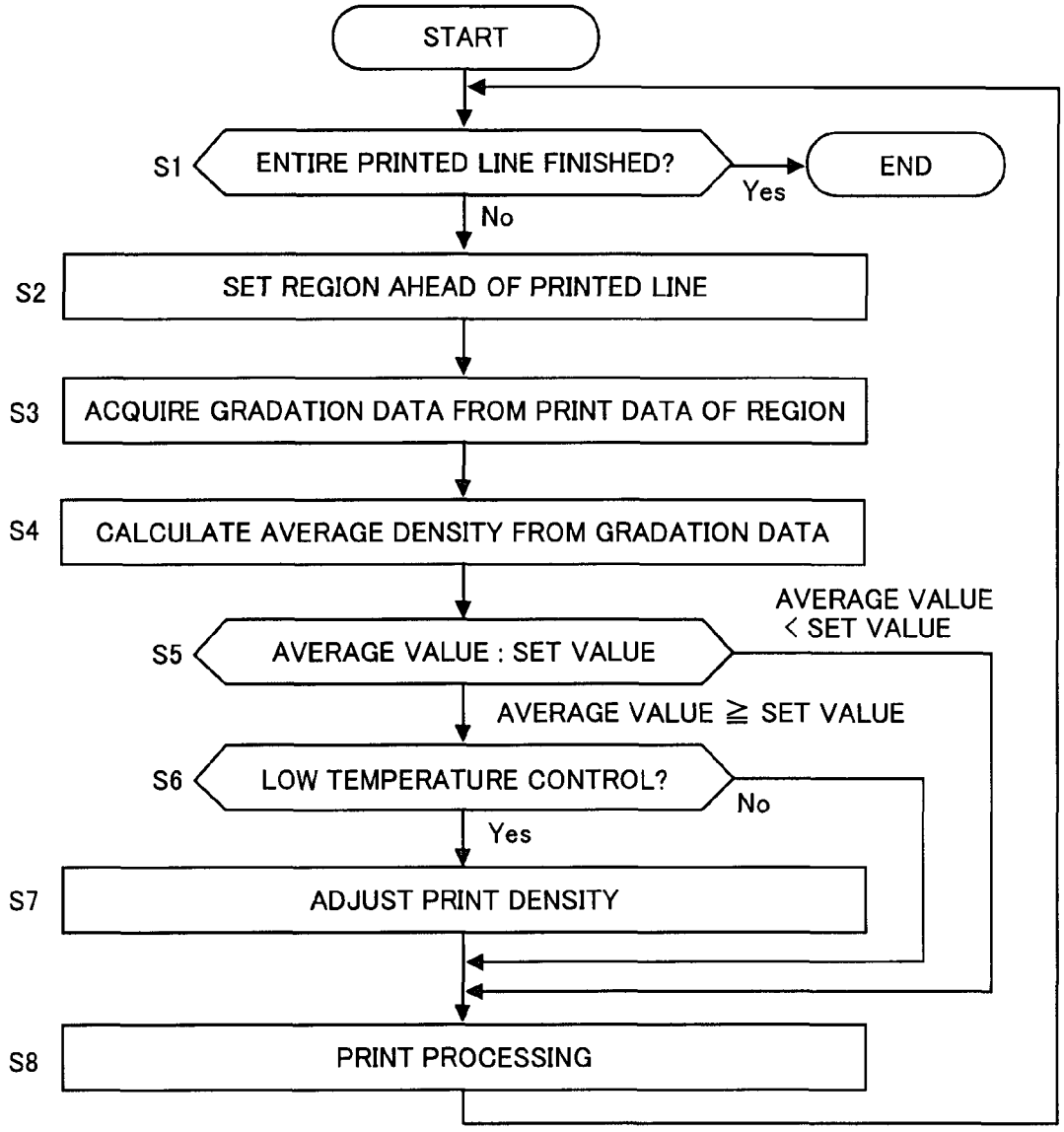
FIG. 5 is a flowchart illustrating an example of the operation in the first mode of the present invention.

Next, the flowchart of FIG. 5 will be used to describe an example of the operation in the first mode of the present invention. A case of a single color will be described here.

First, the predetermined regions are set for the print data prior to the printed line. Here, the "print data prior to the printed line" is print data that has been processed at some time prior to the current print data in print processing, and has already undergone printing, and is shown as the predetermined regions 30*a* and 30*b* in FIG. 3 (S2).

Gradation data is acquired from the print data included in the set predetermined region 30. When the predetermined region 30 is made up of m×n dots, m×n pieces of gradation data are acquired (S3). The acquired gradation data is averaged to find the average density, and this average density is taken as the density evaluation value (S4).

The calculated average density is compared to a set value that has been determined in advance. In this comparison processing, the set value is a threshold value for determining from density whether or not the temperature reached by heating during printing in the predetermined regions has exceeded the temperature at which wrinkling occurs in the ink ribbon. The set value can be predetermined by experimentation, simulation, etc. (S5).

In this comparison, if the average density exceeds the set value, it is determined that the temperature reached by heating in printing in the predetermined regions exceeds the temperature at which the ink ribbon will wrinkle. When the thermal printer is performing low-temperature control (S6), print density is adjusted for the high-density portion (S7), and printing is performed by supplying drive current to the head on the basis of the adjusted print density (S8). Steps S2 to S8 are performed for every line (S1).

In step S2, if there is no print data processed in the time prior to the current print data, this step is omitted and the print processing step S8 is performed. If there is not enough data in the predetermined regions, then steps S4 to S8 are performed using just the acquired print data.

FIG. 6 consists of diagrams illustrating the adjustment of the print density. As shown in FIG. 1, the adjustment of print density in the present invention is performed by adjusting the density characteristics for high-gradation portions in a gamma table showing density with respect to gradation.

Figure 6A:
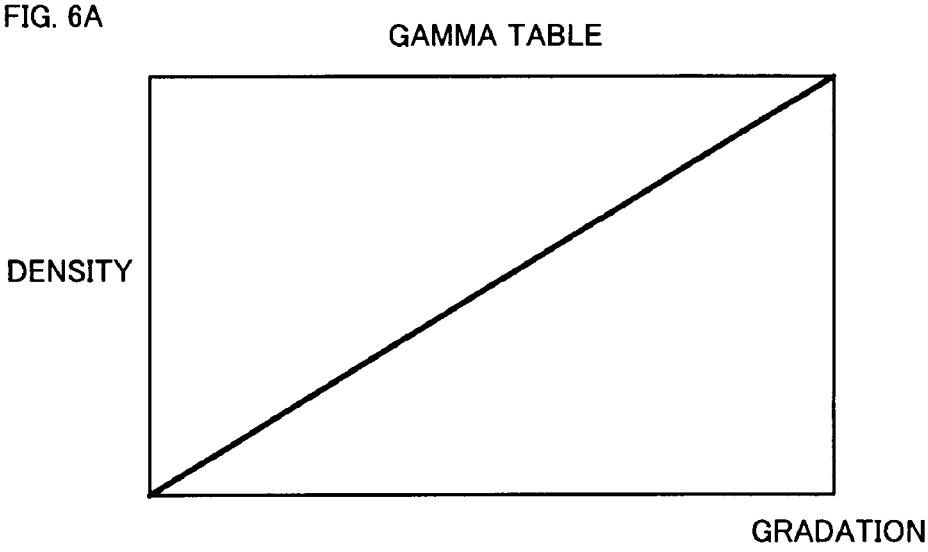
FIGS. 6A-6C illustrates the adjustment of the print density.

FIG. 6A is a gamma table that is used ordinarily, and shows an example in which density with respect to gradation is handled with a linear relationship. With this gamma table, density is linearly set according to changes in gradation, and the current supplied to the head is increased linearly as the gradation increases, thereby expressing how dark the print is.

Figure 6B:
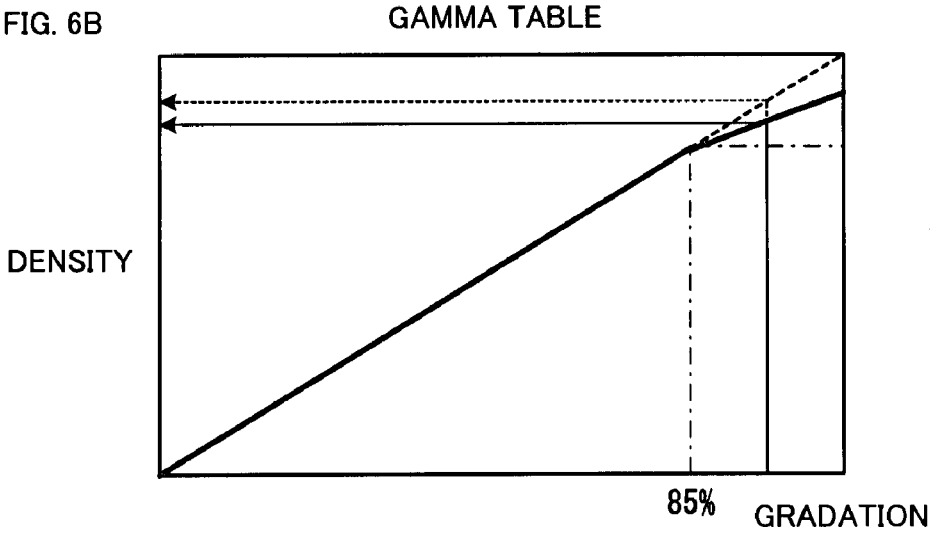
Figure 6C:
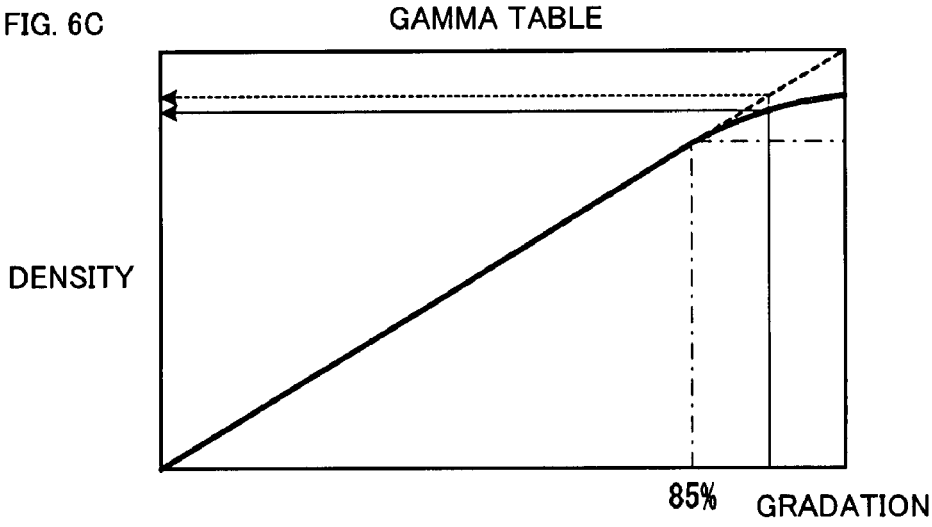

In contrast, FIGS. 6*b* and 6*c* are examples of gamma tables in which the density adjustment of the present invention is performed. FIG. 6B is an example in which the slope of the density with respect to the gradation is reduced in the portions of high gradation, and density adjustment is performed so as to minimize changes in density with respect to rising gradation. In FIG. 6B, in the high-gradation portion, in which the gradation is over 85% of the entire gradation range, density adjustment is performed so as to reduce the slope of gradation. In FIG. 6B, the broken line indicates the slope of gradation when density adjustment is not performed, and the solid line indicates the slope of gradation when density adjustment is performed. Reducing the slope of the density here allows the corresponding density to be kept low in gradation that exceeds 85%.

FIG. 6C is an example in which the slope characteristics of density with respect to gradation is reduced in a curve in the portion of high gradation, and density adjustment is performed so as to minimize changes in density with respect to rising gradation. In FIG. 6C, in the high-gradation portion, in which the gradation is over 85% of the entire gradation range, density adjustment is performed with a quadric curve in which the slope of density gradually decreases. In FIG. 6C, the broken line indicates the slope of gradation when density adjustment is not performed, and the solid line indicates the slope of gradation when density adjustment is performed. Adjusting the characteristics of the density here allows the corresponding density to be kept low in gradation that exceeds 85%.

The range over which density adjustment is performed is given as 85% and above here, but is not limited to this numerical value, but when gradation higher than 40% is used as the range of density adjustment, unnaturalness of the printed image will become noticeable, so the range of density adjustment is preferably at least 40% and above.

In the above-mentioned density adjustment, the extent to which the slope is increased with respect to the gradation increase can be set by using a density evaluation value.

Here, a load ranking is set according to the density evaluation value, and the slope of density adjustment is set according to this load ranking. The parameter for determining the slope of density adjustment can also be the ambient temperature surrounding the head, in addition to the load ranking mentioned above. If the ambient temperature around the head is low, temperature control is performed to increase the drive current at low temperatures, and this increased current is set higher as the ambient temperature becomes lower.

In view of this, the slope of density adjustment is set smaller as the load ranking (which corresponds to a higher print density) becomes higher, and the slope of density adjustment is set smaller as the ambient temperature becomes lower. FIG. 7 shows examples of the slope of density adjustment. FIG. 7 shows a case of setting the slope of density adjustment in ten stages.

Figure 8A:
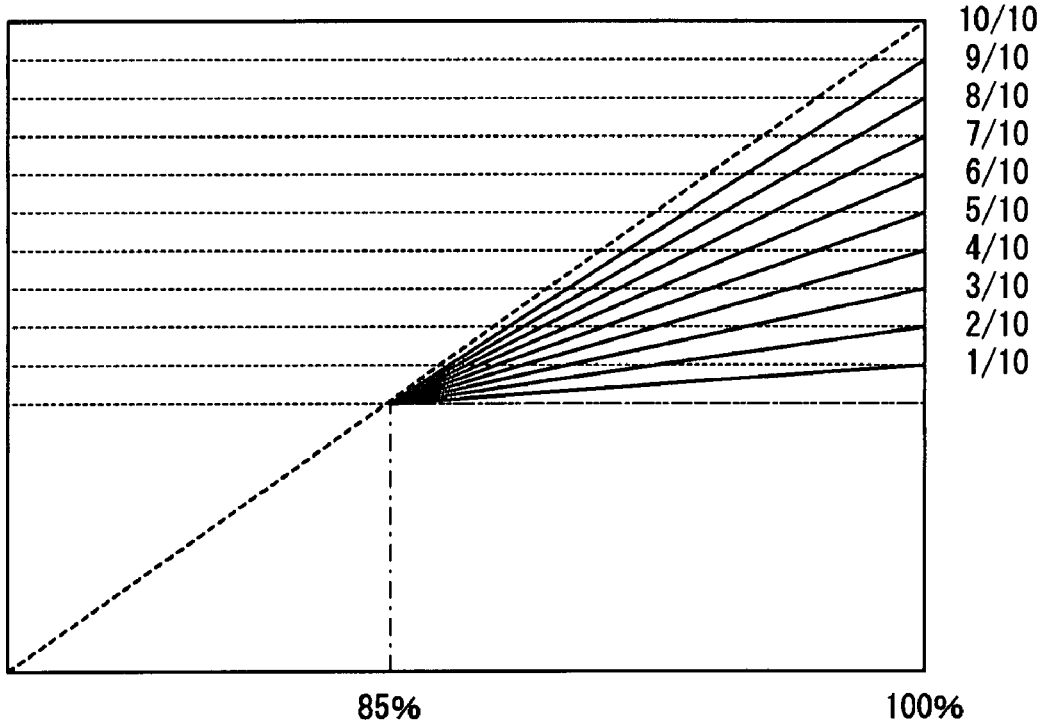
FIGS. 8A-8B illustrates an example of the slope of density adjustment in the first mode of the present invention.
Figure 8B:
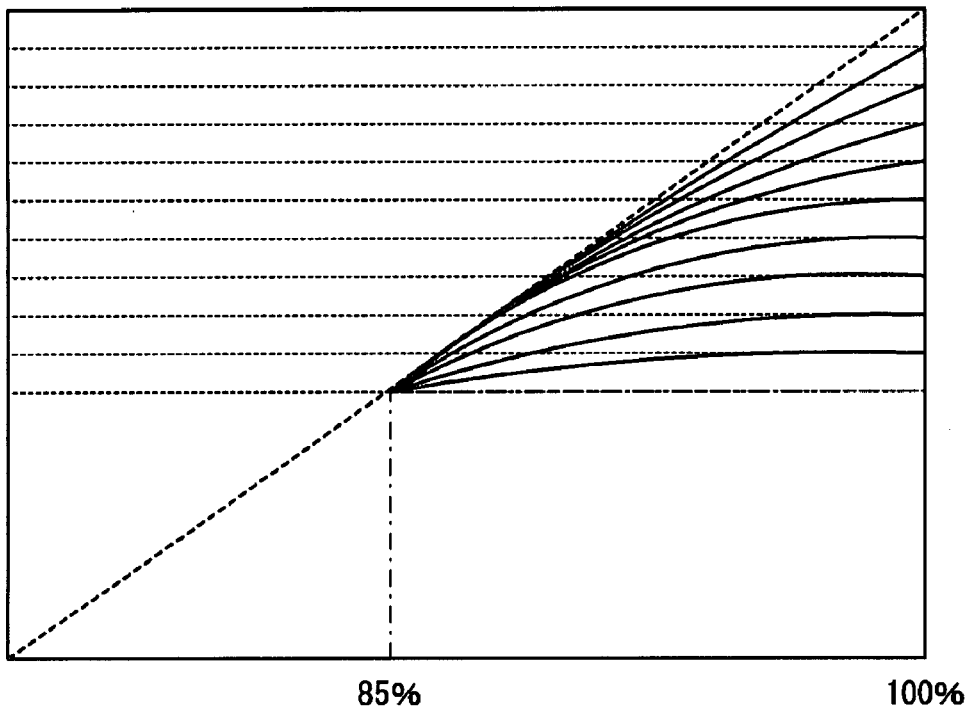

FIG. 8 consists of diagrams of an example of the slope of density adjustment. FIG. 8A is an example of linear adjustment, and FIG. 8B is an example of curve adjustment.

In the example in FIG. 8A, the slope of linear adjustment is shown broken down into ten stages from 1/10 to 10/10 within the range of density adjustment, while FIG. 8B shows an example in which the density at 100% in the range of density adjustment is broken down into ten stages from 1/10 to 10/10 and this range of density adjustment is subjected to curve adjustment.

In calculating the density evaluation value, weighting can be performed in evaluating the prior print data. For instance, depending on the length of the interval between current printing and prior printing, the effect that prior print data has on the temperature of the thermal head may vary. How much the prior print data contributes to the density evaluation value can be fixed by weighting.

Figure 9:
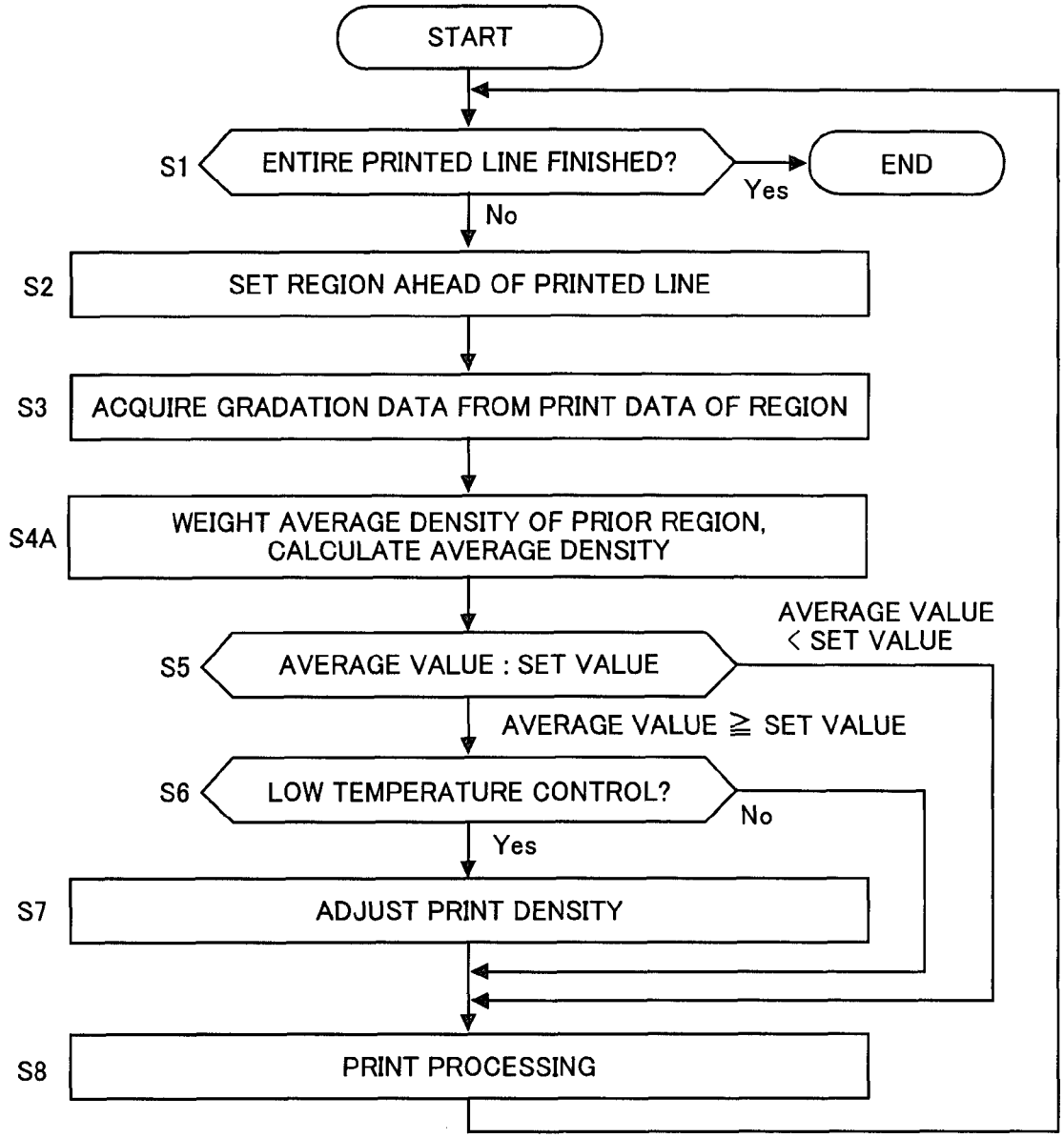
FIG. 9 is a flowchart illustrating the operation when weighting is performed in the first mode of the present invention.
Figure 10:
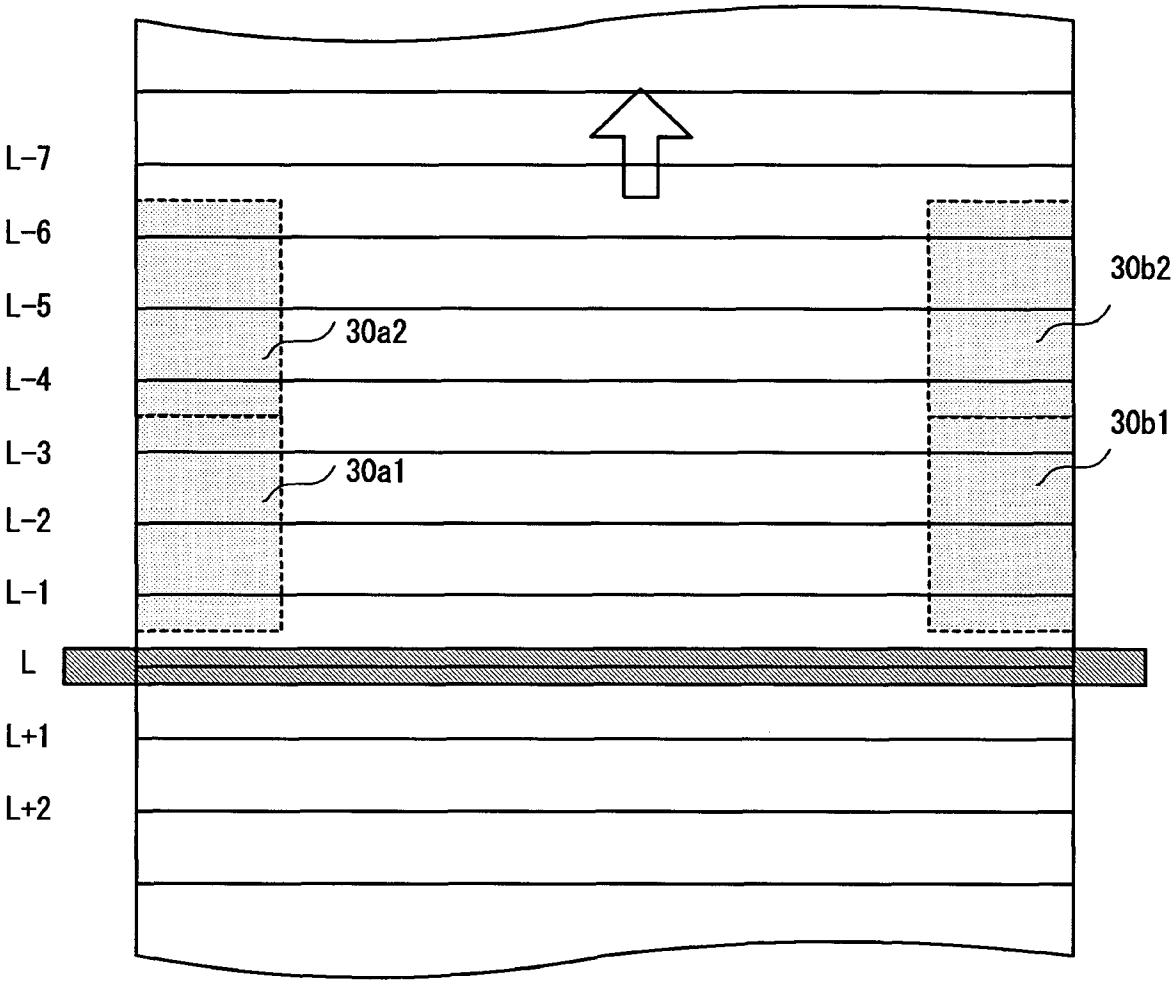
FIG. 10 is a diagram illustrating the operation when weighting is performed in the first mode.

FIGS. 9 and 10 are a flowchart and a diagram illustrating the operation here. In the flowchart of FIG. 9, the average density is calculated by weighting the average density of the prior region in step S4 in the flowchart of FIG. 5. In FIG. 10, for example, with the regions 30*b*1 and 30*b*2, the effect that the region 30*b*2 has on a printed line is estimated to be less than that of the region 30*b*1. In view of this, the effect on a printed line is adjusted by making the weighting to average density calculated for the region 30*b*2 be less than the weighting to average density calculated for the region 30*b*1 (S4A). In the flowchart, everything other than S4A is the same as in the flowchart of FIG. 5, so the rest will not be described here.

The calculation processing for the density evaluation value performed by the above-mentioned density calculator is shown for printing in one color, but can also be applied to multicolor printing.

In the multicolor printing with ink ribbons of a plurality of colors, the density controller calculates the density evaluation value for print data of a current printing color by adding a value obtained by weighting a density evaluation value calculated for a printing color prior to the current printing color, to a value obtained by finding the average gradation value of print data for each of a plurality of dots included in the predetermined region, as discussed above.

This weighting can be determined according to the order in which the colors are printed, or can be set to a value that becomes smaller as the elapsed time with the current printing color becomes greater, or can be determined according to the elapsed time.

Figure 11:
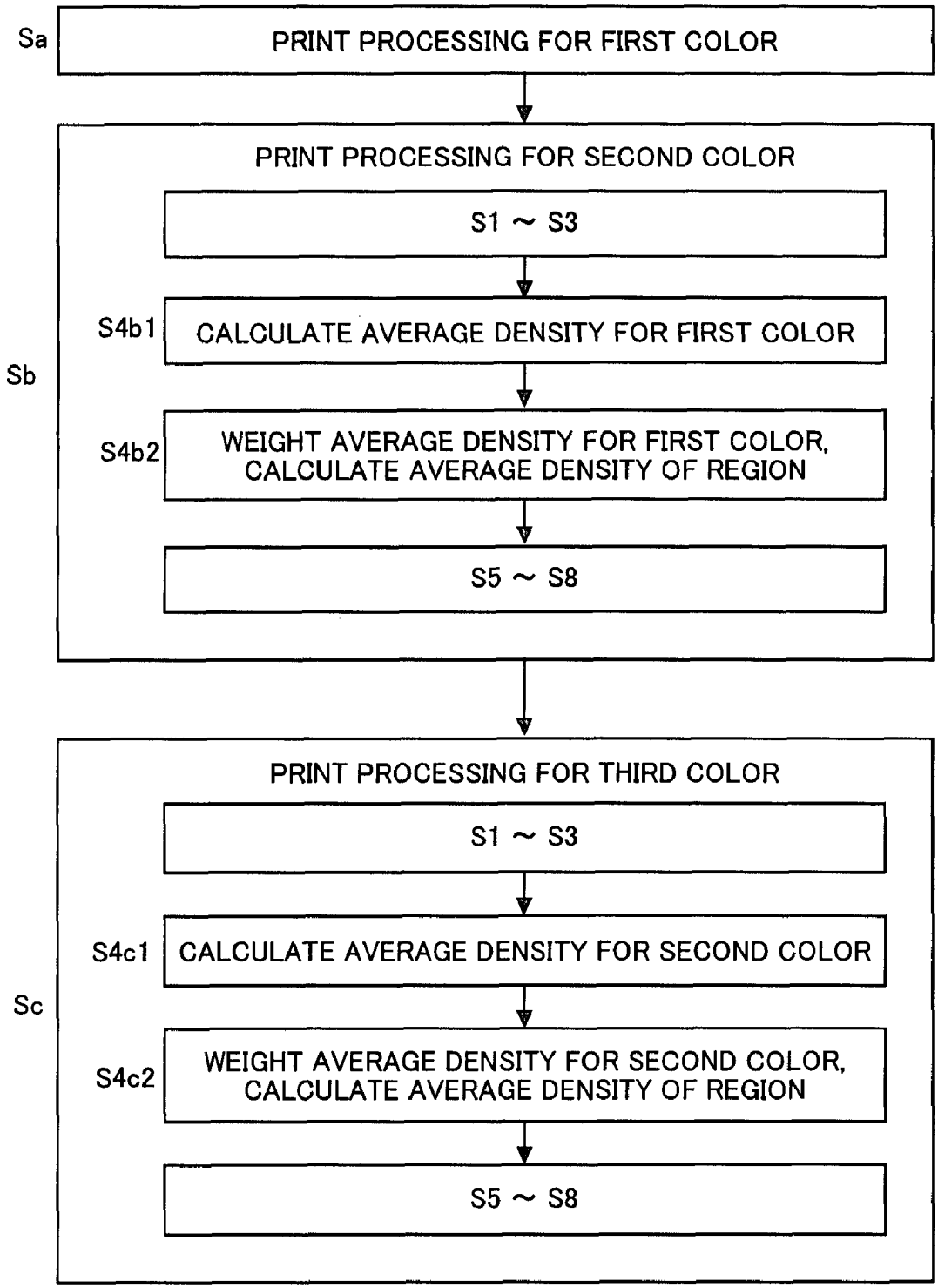
FIG. 11 is a flowchart illustrating the processing of multicolor printing in the first mode of the present invention.
Figure 12A:
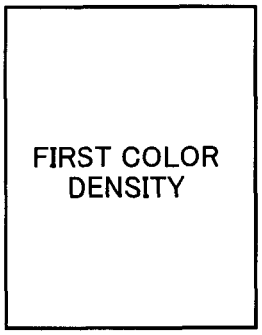
FIGS. 12A-12C illustrates the processing of multicolor printing in the first mode of the present invention.
Figure 12B:
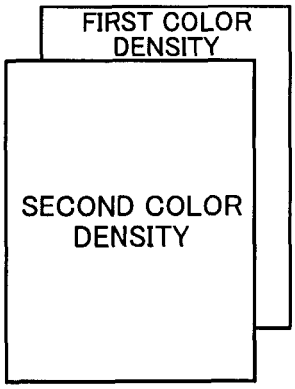
Figure 12C:
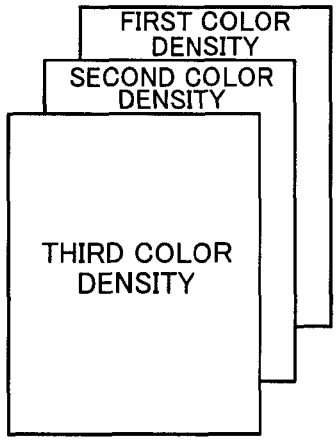

FIG. 11 is a flowchart illustrating the processing of multicolor printing, and FIG. 12 is a simplified diagram illustrating the processing of multicolor printing. Here, a case is depicted in which the multicolor printing is three-color printing, such as the colors yellow, magenta, and cyan.

First, print processing is performed for one of the colors. This print processing can be carried out according to the flowchart shown in FIG. 5. FIG. 12A schematically shows the average density of the first color (Sa).

Next, after the print processing is completed for the first color, the print processing of the second color is performed (Sb). In the print processing of the second color, just as in steps S1 to S3 in the above-mentioned flowchart, gradation data is acquired and then the average density of the first color is calculated (S4*b*1). The average density of the predetermined region is calculated on the basis of the print data for the second color. In the calculation of the average density of the region for the second color, the value weighted to the first color and calculated in the previous step is added to the average density found on the basis of the print data for the second color. FIG. 12B schematically shows the average density of the first and second colors (S4*b*2).

The print processing for the second color is performed by carrying out the processing of steps S5 to S8 in the above-mentioned flowchart using the average density calculated in S4*b*1 and S4*b*2.

Next, after the print processing is completed for the second color, the print processing of the third color is performed (Sc). In the print processing of the third color, just as in steps S1 to S3 in the above-mentioned flowchart, gradation data is acquired and then the average density of the second color is calculated (S4*c*1). The average density of the predetermined region is calculated on the basis of the print data for the third color. In the calculation of the average density of the region for the third color, the value weighted to the second color and calculated in the previous step is added to the average density found on the basis of the print data for the third color. FIG. 12A schematically shows the average density of the first, second, and third colors (S4*c*2).

The print processing for the third color is performed by carrying out the processing of steps S5 to S8 in the above-mentioned flowchart using the average density calculated in S4*c*1 and S4*c*2.

The above calculation processing of the density evaluation value by the density calculator is shown for printing a single sheet, but can also be applied to continuous printing of a plurality of sheets.

In the continuous printing of a plurality of sheets, the density evaluation value is calculated for current print data by adding a value obtained by weighting a density evaluation value calculated for the printing prior to the current printing, to a value obtained by finding the average gradation value of print data for each of a plurality of dots included in the predetermined region, as discussed above. This weighting can be determined according to a past printing state, or can be set to a value that becomes smaller as the elapsed time until the current printing becomes greater, or can be determined according to the elapsed time.

Figure 13:
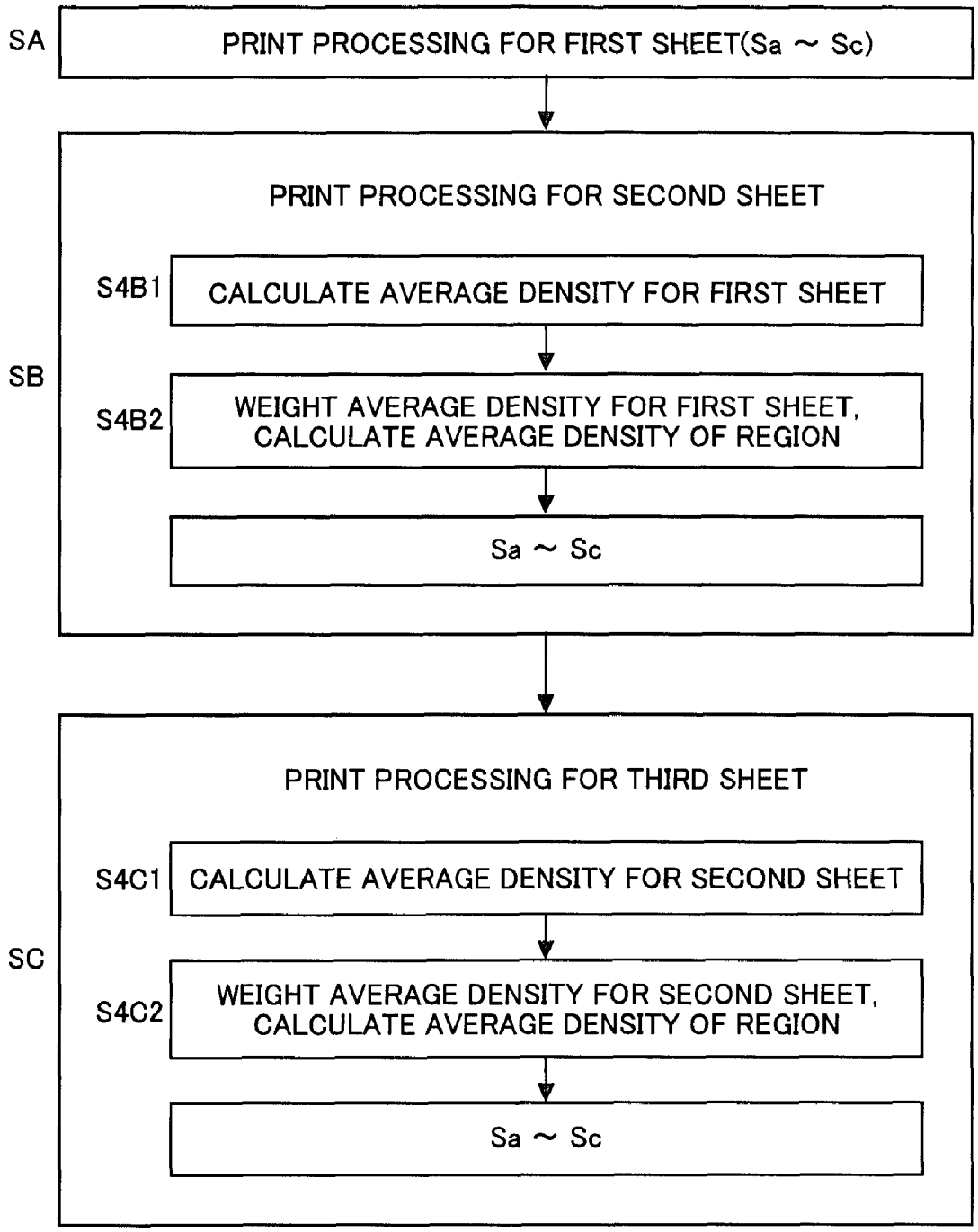
FIG. 13 is a flowchart illustrating the processing of multi-sheet printing in the first mode of the present invention.
Figure 14A:
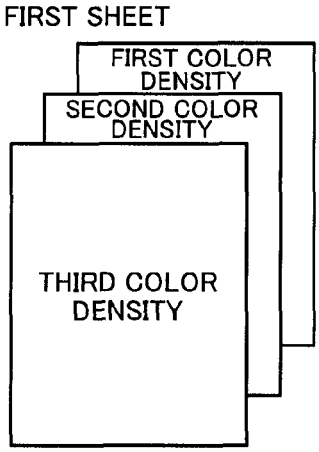
FIGS. 14A-14C illustrates the processing of multi-sheet printing in the first mode of the present invention.
Figure 14B:
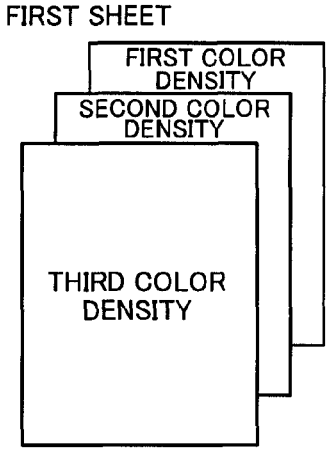
Figure 14C:
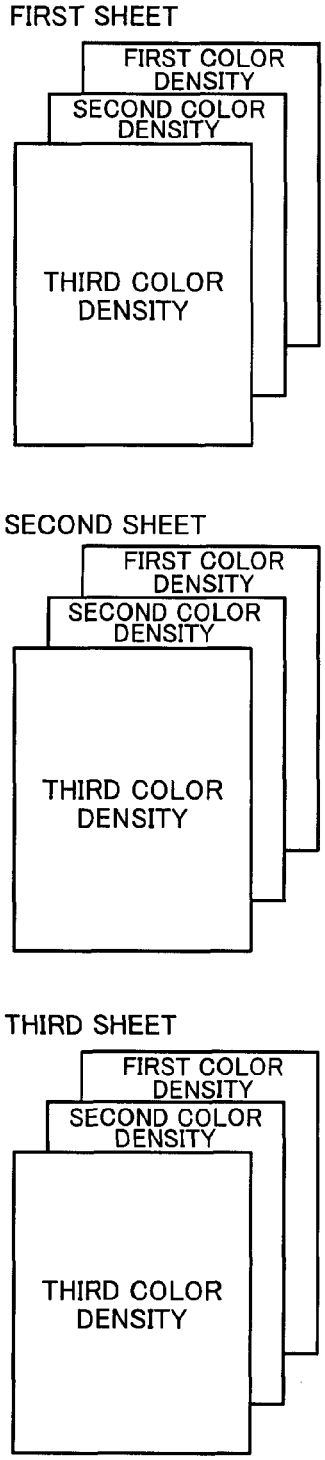

FIG. 13 is a flowchart illustrating the processing of multi-sheet printing, and FIG. 14 is a simplified diagram. Here, a case is depicted in which the printing of three sheets is performed as multi-sheet printing.

First, print processing is performed for the first sheet. This print processing can be carried out according to the flowchart shown in FIG. 11. FIG. 14A schematically shows the average density when the first sheet is printed in multiple colors (SA).

Next, after the print processing is completed for the first sheet, the print processing of the second sheet is performed (SB). In the print processing of the second color, just as above, gradation data is acquired and then the average density of the first sheet is calculated (S4B1). The average density of the predetermined region is calculated on the basis of the print data for the second sheet. In the calculation of the average density of the region for the second sheet, the value weighted to the average density of the first sheet and calculated in the previous step is added to the average density found on the basis of the print data for the second sheet. FIG. 14B schematically shows the average density of the first and second sheets (S4B2).

The print processing for the second sheet is performed by carrying out the processing of steps Sa to Sc in the above-mentioned flowchart using the average density calculated in S4B1 and S4B2.

Next, after the print processing is completed for the second sheet, the print processing of the third sheet is performed (SC). In the print processing of the third sheet, just as above, gradation data is acquired and then the average density of the second sheet is calculated (S4C1). The average density of the predetermined region is calculated on the basis of the print data for the third sheet. In the calculation of the average density of the region for the third sheet, the value weighted to the second sheet and calculated in the previous step is added to the average density found on the basis of the print data for the third sheet. FIG. 14A schematically shows the average density of the first, second, and third sheets (S4C2).

The print processing for the third sheet is performed by carrying out the processing of steps Sa to Sc in the above-mentioned flowchart using the average density calculated in S4C1 and S4C2.

Next, an example of the second mode of the present invention will be described through reference to FIGS. 15 to 20.

The second mode is one in which whether wrinkling has occurred is determined from the density state at both ends in the printing width direction of the thermal head and at the inside part sandwiched between these two ends, and density evaluation and control of the print density based on this density evaluation are carried out for each printed image.

Figure 15:
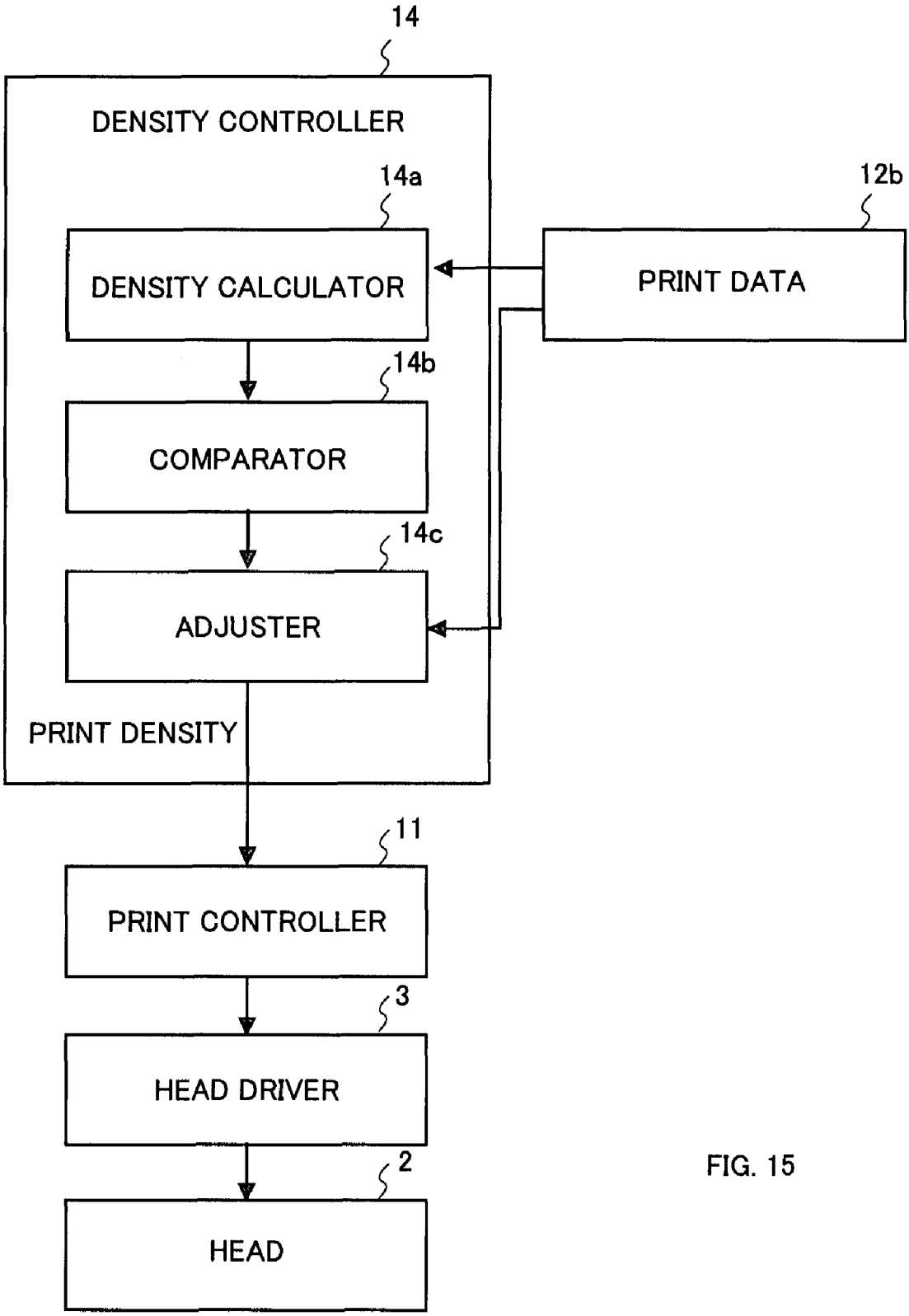
FIG. 15 is a diagram illustrating the density controller in the second mode of the present invention.

FIG. 15 is a diagram illustrating an example of the density controller 14 in the second mode of the present invention. In FIG. 15, the density controller 14 comprises a density calculator 14*a* for calculating the density evaluation value by finding the average gradation value for print data for each of a plurality of dots included in the predetermined region, a comparator 14*b* for comparing the calculated density evaluation value with a predetermined value, and an adjuster 14*c* for adjusting, on the basis of this comparison result, the print density of the thermal head to a low value for print data of high gradation exceeding a predetermined gradation value in print data on a printed line when the density evaluation value exceeds a predetermined value. The density controller 14 controls the printing of the various dots by the thermal head on the basis of the adjusted print density.

The density calculator 14*a* finds the average gradation value for the print data of a plurality of dots selected from the plurality of dots included in the predetermined region, assigns a weighting coefficient to each reed shaped region in the paper feed direction on the basis of the average value, finds the sum of these weighting coefficients, and calculates the density evaluation value from this sum. The weighting coefficients here are preset for each reed shaped region in the paper feed direction, and when, in the array of the average values included in the reed shaped regions in the paper feed direction, the number of continuous selection points at which this average value exceeds a predetermined value is equal to or greater than a predetermined proportion with respect to the number of selection points included in the paper feed direction, the density calculator 14*a* assigns the set weighting coefficient to each reed shaped region. On the other hand, if the number of continuous selection points at which this average value exceeds a predetermined value does not exceed the predetermined proportion with respect to the number of selection points included in the paper feed direction, a coefficient of "0" is assigned to this reed shaped region.

With these weighting coefficients, for example, a large weighting coefficient is set for the reed shaped regions at both ends, and a small weighting coefficient is set for the middle part sandwiched between the two ends, which allows the weighting to be increased for the portion that contributes greatly to the wrinkling of the ink ribbon, and the weighting to be decreased for the portion that contributes little to the wrinkling of the ink ribbon.

The adjuster 14*c* adjusts the print density to a low value by decreasing the print density of the thermal head by a predetermined proportion with respect to a gradation value between 85% and 100% of the total gradation width for the gradation value of each dot when the gradation value of the dots on a printed line is a high gradation value that exceeds 85% of the total gradation range, for example. This adjustment may be linear adjustment in which the slope of the print density with respect to the gradation value is less than 1, or may be curve adjustment of the print density with respect to the gradation value with a quadric curve having a predetermined decreasing slope characteristic.

In the case of linear adjustment, the slope is set according to the ambient temperature, relationship between the ambient temperature and the slope of the print density with respect to the gradation value is a positive relationship, and the slope of the print density with respect to the gradation value can be set smaller as the ambient temperature becomes lower.

Figure 16:
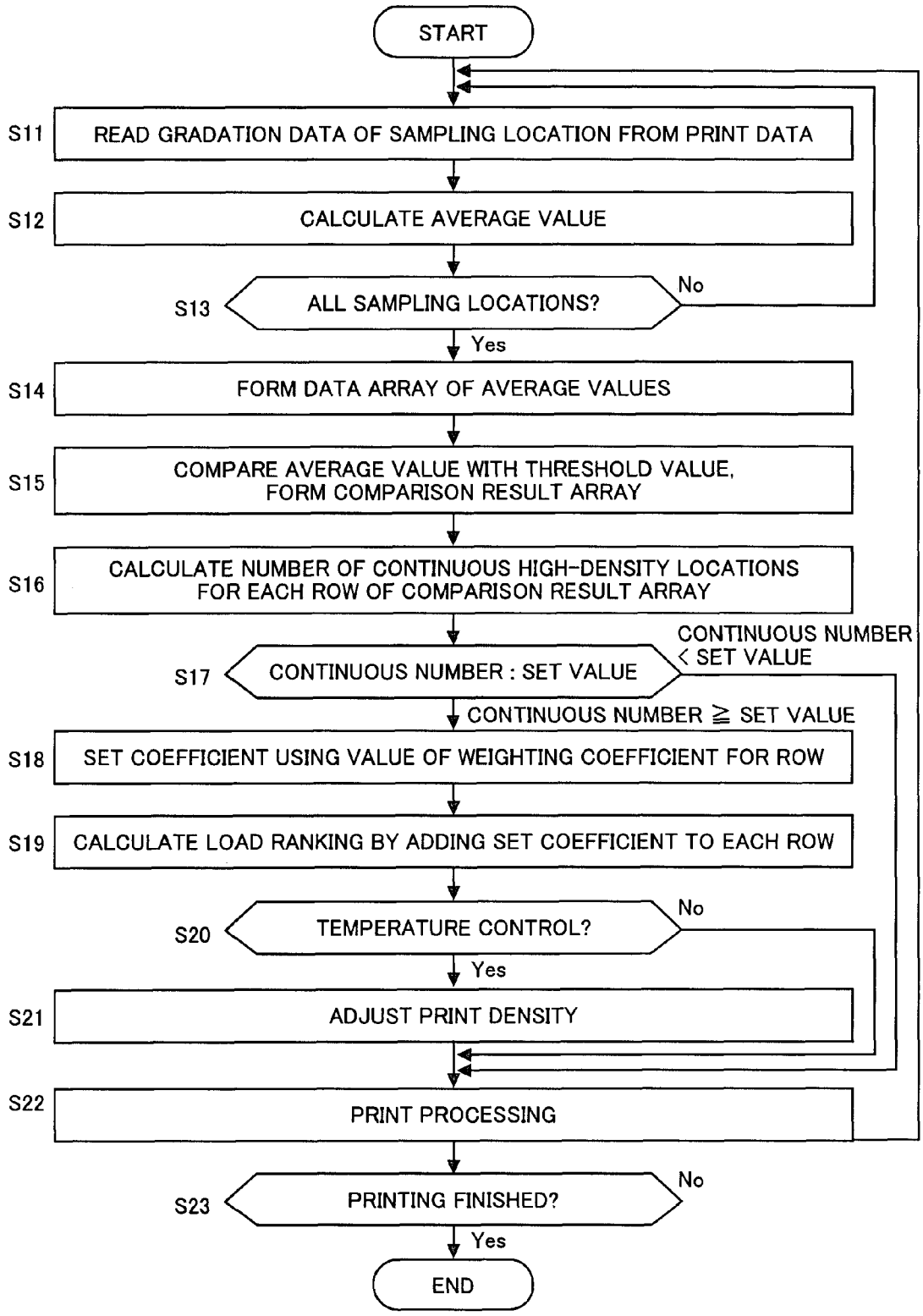
FIG. 16 is a flowchart illustrating an example of the operation in the second mode of the present invention.

The operation in the second mode of the present invention will now be described through reference to the flowchart of FIG. 16 and the diagrams of FIGS. 17 to 20.

First, gradation data for the sampling site is read from the print data. In this second mode, density evaluation and control of the print density based on this density evaluation are performed for every printed image, so the density state based on the entire print data is determined. Here, if processing is performed using all of the print data, this will entail a tremendous amount of data processing and take a long time, so just a sample of the print data is used.

Figure 17A:
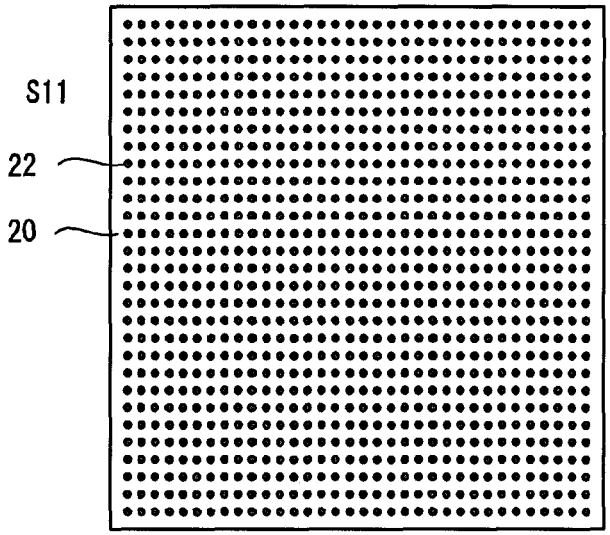
FIGS. 17A-17C illustrates an example of the operation in the second mode of the present invention.
Figure 17B:
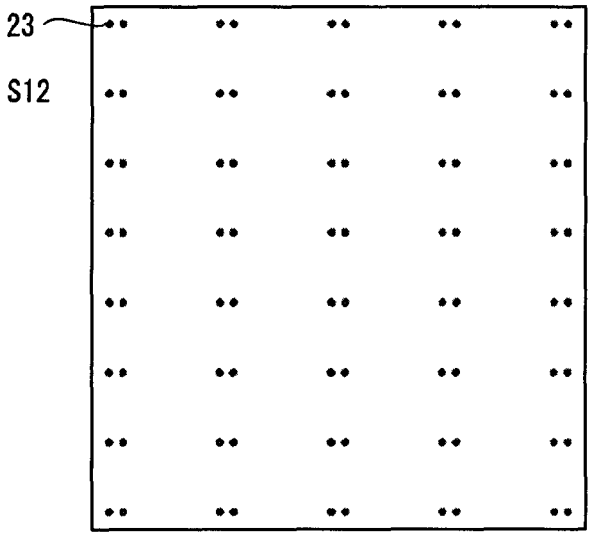

In the second mode, reed shaped regions set at both ends in the printing width direction and in at least one middle part sandwiched between the two ends, and that extend in the paper feed direction, are set as the predetermined region, and data selected from the data in this predetermined region is used. FIG. 17A is a diagram of how the print data is developed into a printed image, and can be considered as a data array in which the dot data 22 of the print data is arranged in a lattice pattern so as to be matched to the print locations during printing. Print data at the selection points is selected form this data array, and the average value is calculated. FIG. 17B schematically illustrates the data array at the selection points.

Figure 18A:
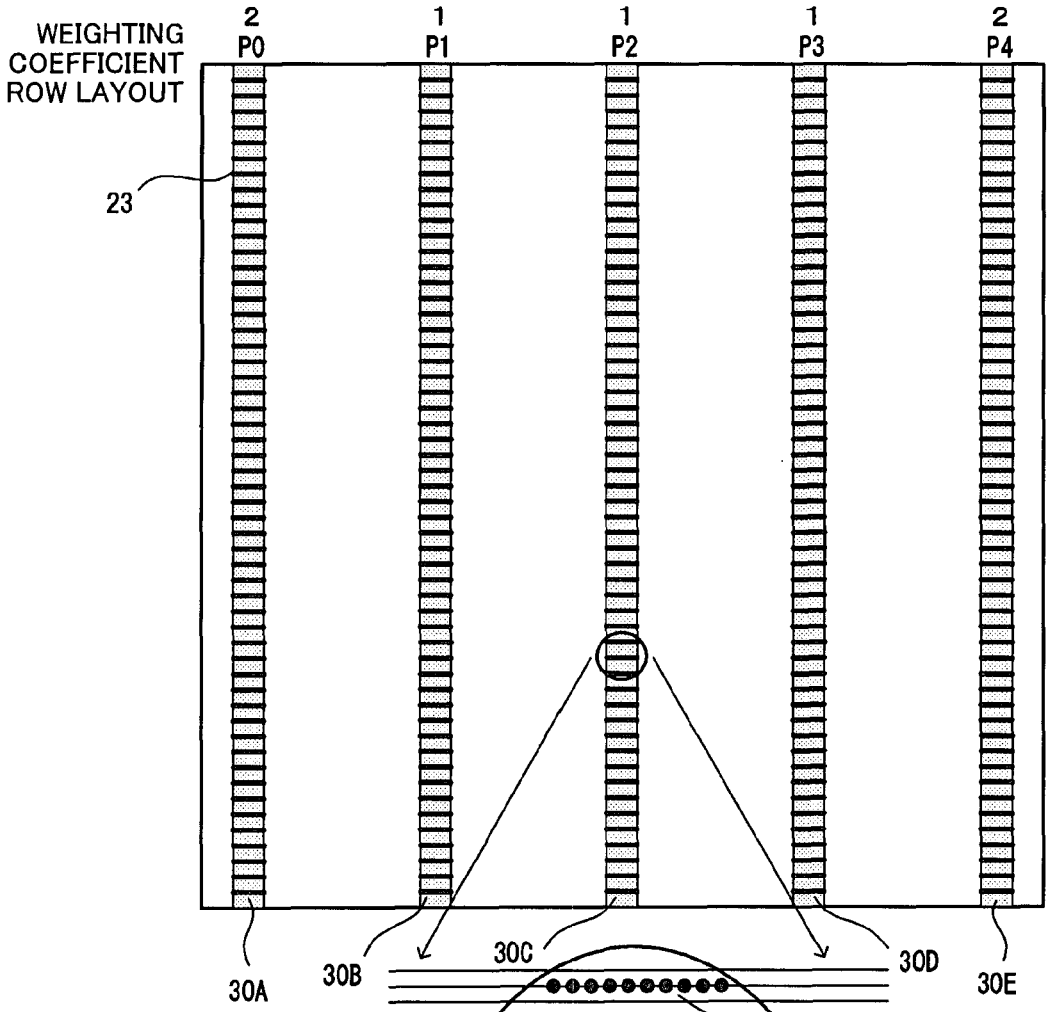
FIGS. 18A-18B illustrates an example of the operation in the second mode of the present invention.
Figure 18B:
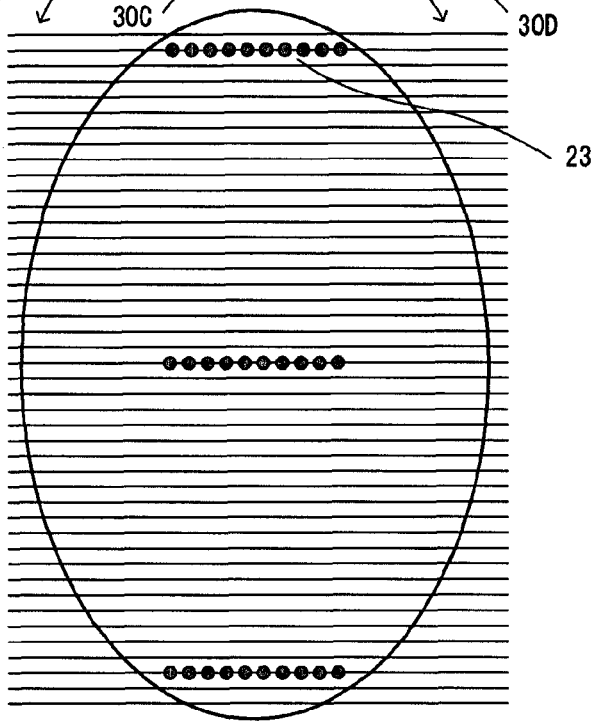

FIG. 18 is a diagram illustrating the predetermined region, for illustrating the selection of print data at these selection points. In the print data array shown in FIG. 18A, the predetermined regions 30A to 30E are reed shaped regions extending in the paper feed direction and set at the two ends in the printing width direction and at three middle portions sandwiched between the two ends. The predetermined regions 30A and 30E are regions provided at the two ends, while the predetermined regions 30B to 30D are regions set in the middle portions. In these reed shaped regions, the selected print data includes, for example, ten dots 23 in the printing width direction, and is selected every 20 lines. FIG. 18B shows part of a predetermined region. The numbers of dots and lines can be set as desired, and are not limited to ten dots and 20 lines. Performing this sampling for all the print data allows print data to be selected from the reed shaped regions set in the print data (S13).

Figure 17C:
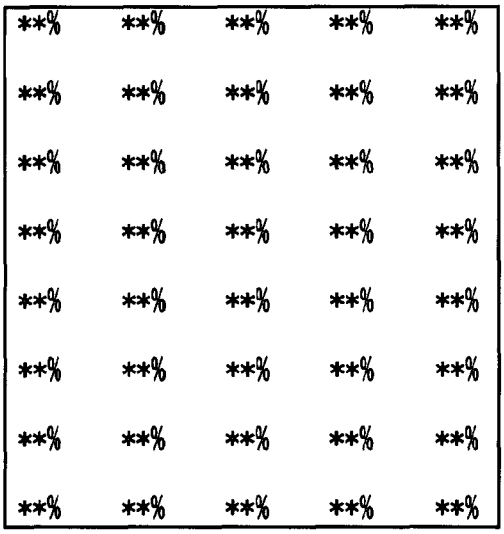

FIG. 17C shows the array state of the average values of selected print data. Since the average values correspond to print density, the array of the average values thus obtained corresponds to the density distribution of the print data (S14).

Next, the data array of average values expressing the density distribution of the print data thus found is used to choose a high-density portion, and the distribution state of the portion with high density is found. This processing can be performed by comparing the average values with a threshold value, and laying out the comparison results. FIGS. 19 and 20 show examples of the array of comparison results. In these examples, if the highest density is expressed as 100%, the threshold value is set to 85%, and the range of high density is from 85 to 100%. Also, in FIGS. 19 and 20, a "O" indicates that the average value is at least 85%, while a "x" indicates that the average value is less than 85%.

For instance, in the evaluation example in FIG. 19A, the entire data array of average values is at least 85%, whereas in the evaluation example in FIG. 19B, the entire data array of average values is less than 85% (S15).

Next, the array of comparison results is used to determine whether or not a predetermined region has high density. This evaluation can be performed a variety of ways, but as an example, the continuous length of a high-density portion is found in a row of a predetermined region out of the array of comparison results, and the evaluation is performed on the basis of this length.

The number of continuous high-density portions in a predetermined region is calculated (S16), and this continuous number is compared with a set value. If the continuous number is greater than the set value, this region is determined to be a high-density region, and if the continuous number is less than the set value, this region is determined not to be a high-density region. This evaluation can be performed, for example, by using "3/8" as the set value when the overall length is "1," and comparing this set value (3/8) with the ratio of the length of the continuous number to the overall length. This set value of 3/8 is just an example, and other numeric values are also possible.

In step S17, if the reed shaped predetermined region is determined to be a high-density region, then a coefficient is set by using the value of a predetermined weighting coefficient for the row of this predetermined region. The coefficient set for the row of this predetermined region is used to determine whether or not print density adjustment is to be performed, and the value of the weighting coefficient is predetermined for the reed shaped predetermined regions. The determination of whether or not a reed shaped predetermined region is a high-density region that is performed in step S17 decides whether or not the value of this weighting coefficient will be assigned.

If a predetermined region is determined to be a high-density region, the value of the weighting coefficient is assigned, but if the predetermined region is not determined to be a high-density region, the value of the weighting coefficient is not assigned. The processing for not assigning the value of the weighting coefficient can be performed by assigning a value of "0," for example.

In FIG. 19A, for instance, "2" is preset as the weighting coefficient for the predetermined regions P1 and P5, which correspond to the two ends, and "1" is preset as the weighting coefficient for the predetermined regions P2 to P3, which correspond to the middle portion sandwiched between the two ends. Setting a large weighting coefficient to the predetermined regions P1 and P5 corresponding to the two ends can be used to evaluate whether or not a region has a high print density and has the potential for ink ribbon wrinkling. This value of the weighting coefficient is just an example, and other values are also possible.

In the example in FIG. 19A, since all of the predetermined regions P1 to P5 are determined to have high density, the value of the set weighting coefficient is assigned to these regions. In the drawing, coefficients of 2, 1, 1, 1, and 2 are assigned in that order to the predetermined regions P1 to P5. In the example in FIG. 19B, since none of the predetermined regions P1 to P5 are determined to have high density, a value of "0" is assigned as a coefficient to each region.

In the example in FIG. 19C, the predetermined regions P1, P3, and P5 are determined to have high density, while the predetermined regions P2 and P4 are determined not to have high density, so coefficients of 2, 0, 1, 0, and 2 are assigned in that order to the predetermined regions P1 to P5.

Similarly, in the example in FIG. 19D, the predetermined regions P1 and P5 are determined to have high density, while the predetermined regions P3 to P5 are determined not to have high density, so coefficients of 2, 0, 0, 0, and 2 are assigned in that order to the predetermined regions P1 to P5.

In the example in FIG. 20A, the predetermined regions P1 and P4 are determined to have high density, while the predetermined regions P2, P3, and P5 are determined not to have high density, so coefficients of 2, 0, 0, 1, and 0 are assigned in that order to the predetermined regions P1 to P5. In the example in FIG. 20B, the predetermined region P1 is determined to have high density, while the predetermined regions P2 to P5 are determined not to have high density, so coefficients of 2, 0, 0, 0, and 0 are assigned in that order to the predetermined regions P1 to P5. In the example in FIG. 20C, the predetermined region P3 is determined to have high density, while the predetermined regions P1, P2, P4, and P5 are determined not to have high density, so coefficients of 0, 0, 1, 0, and 0 are assigned in that order to the predetermined regions P1 to P5. In the example in FIG. 20D, the predetermined regions P1 to P5 are not to have high density, so coefficients of 0, 0, 0, 0, and 0 are assigned in that order to the predetermined regions P1 to P5 (S18).

In step S18, a load ranking is calculated by adding up the coefficients assigned to the predetermined region of each row. This load ranking serves as an index for determining whether or not to perform adjustment of the print density, and also as an index for deciding the extent of adjustment.

In the example in FIG. 19A, coefficients of 2, 1, 1, 1, and 2 are added up, so the load ranking is 7 (=2+1+1+1+2). In the example in FIG. 19B, coefficients of 0, 0, 0, 0, and 0 are added up, so the load ranking is 0 (=0+0+0+1+0); in the example in FIG. 19C, coefficients of 2, 0, 1, 0, and 2 are added up, so the load ranking is 5 (=2+0+1+0+2); and in the example in FIG. 19D, coefficients of 2, 0, 0, 0, and 2 are added up, so the load ranking is 4 (=2+0+0+0+2). Similarly, in the example in FIG. 20A, coefficients of 2, 0, 0, 1, and 0 are added up, so the load ranking is 3 (=2+0+0+1+0); in the example in FIG. 20B, coefficients of 2, 0, 0, 0, and 0 are added up, so the load ranking is 2 (=2+0+0+0+0); in the example in FIG. 20C, coefficients of 0, 0, 1, 0, and 0 are added up, so the load ranking is 1 (=0+0+1+0+0); and in the example in FIG. 20D, coefficients of 0, 0, 0, 0, and 0 are added up, so the load ranking is 0 (=0+0+0+0+0) (S19).

When temperature control is performed to raise the current supplied to the head at low temperatures (S20), the print density is adjusted on the basis of the load ranking calculated in S19 (S21), and printing is performed (S22).

In this adjustment of print density, as shown in FIGS. 7 and 8, the extent of the adjustment is varied according to the load ranking.

In FIG. 7, a number from 0 to 4 is set as the load ranking, and the slope of density adjustment is set smaller as the load ranking becomes higher. Also, in FIG. 7, the load ranking is combined with the ambient temperature in setting the slope of density adjustment, and the slope of density adjustment is set smaller as the temperature becomes lower.

In the setting examples in FIG. 7, since the highest load ranking is 4, density adjustment is performed with the value of the load ranking set at 4 when the highest value of the load ranking is exceeded, as with the load ranking of 7 in FIG. 19A or the load ranking of 5 in FIG. 19C.

The above-mentioned weighting coefficient and the load ranking can be set as desired, and what is depicted in the drawings are only examples, and the present invention is not limited to these examples.

Furthermore, the configuration examples discussed above are nothing but examples, and the present invention is not limited to or by these examples, and encompasses various modifications.

The invention claimed is:

1. A thermal printer for printing on a print medium by thermally transferring an ink ribbon by means of a thermal head, wherein a region set at both ends in a printing width direction is taken as a predetermined region, and the thermal printer comprises a density controller which, in printing with a thermal head, calculates a density evaluation value on the basis of the density of print data within the predetermined region that has been printed prior to said printing, and reduces the print density of the thermal head for print data of a high density that exceeds a predetermined density when said density evaluation value exceeds a predetermined value.

2. The thermal printer according to claim 1, wherein the predetermined region is a region set at both ends in a printing width direction, the density controller comprises:

a density calculator for calculating a density evaluation value by finding an average gradation value of print data for each of a plurality of dots included in the predetermined region;

a comparator for comparing the density evaluation value with a predetermined value; and an adjuster for adjusting, on the basis of this comparison result, the print density of the thermal head to a low value for print data of high gradation exceeding a predetermined gradation value in print data on a printed line when the density evaluation value exceeds a predetermined value, and the density controller controls the printing of each dot by the thermal head on the basis of the adjusted print density.

3. The thermal printer according to claim 2, wherein the adjuster adjusts the print density to a low value by decreasing the print density of the thermal head by a predetermined proportion with respect to a gradation value between 85 % and 100 % of the total gradation width for the gradation value of each dot when the gradation value of the dots on the printed line is a high gradation value that exceeds 85 % of a total gradation range.

4. The thermal printer according to claim 3, wherein the adjustment is performed by subjecting the slope of the print density with respect to the gradation value to linear adjustment at a slope of less than 1.

5. The thermal printer according to claim 4, wherein the slope that is subjected to linear adjustment is set according to an ambient temperature, the relationship between the ambient temperature and the slope of the print density with respect to the gradation value is a positive relationship, and the slope of the print density with respect to the gradation value is set smaller as the ambient temperature becomes lower.

6. The thermal printer according to claim 3, wherein the adjustment is performed by subjecting the print density with respect to the gradation value to curve adjustment with a quadric curve having a predetermined decreasing slope characteristic.

7. The thermal printer according to any one of claims 2 to 6, wherein in multicolor printing with ink ribbons of a plurality of colors, the density calculator calculates the density evaluation value for print data of a current printing color by adding a value obtained by weighting a density evaluation value calculated for a printing color prior to the current printing color, to a value obtained by finding the average gradation value of print data for each of a plurality of dots included in the predetermined region.

8. The thermal printer according to any one of claims 2 to 6, wherein in continuous printing of a plurality of sheets, the density calculator calculates the density evaluation value for current print data by adding a value obtained by weighting a density evaluation value calculated for the printing prior to the current printing, to a value obtained by finding the average gradation value of print data for each of a plurality of dots included in the predetermined region.

9. A thermal printer for printing on a print medium by thermally transferring an ink ribbon by means of a thermal head, wherein a reed shaped region, which is set at the two ends in a printing width direction and at least one middle part sandwiched between the two ends and which extends in a paper feed direction, is taken as a predetermined region, and the thermal printer comprises a density controller which, in printing with a thermal head, calculates a density evaluation value on the basis of the density of print data within the predetermined region that has been printed prior to said printing, and reduces the print density of the thermal head for print data of a high density that exceeds a predetermined density when said density evaluation value exceeds a predetermined value.

10. The thermal printer according to claim 9, wherein the predetermined region is a reed shaped region that is set at the two ends in the printing width direction and at least one middle part sandwiched between the two ends, and that extends in a paper feed direction, the density controller comprises:

a density calculator for calculating a density evaluation value by finding an average gradation value of print data for each of a plurality of dots included in the predetermined region;

a comparator for comparing the density evaluation value with a predetermined value; and an adjuster for adjusting, on the basis of this comparison result, the print density of the thermal head to a low value for print data of high gradation exceeding a predetermined gradation value in print data for a single printed image when the density evaluation value exceeds a predetermined value, and the density controller controls the printing of each dot by the thermal head on the basis of the adjusted print density.

11. The thermal printer according to claim 10, wherein the adjuster adjusts the print density to a low value by decreasing the print density of the thermal head by a predetermined proportion with respect to a gradation value between 85% and 100% of the total gradation width for the gradation value of each dot when the gradation value of the dots of the single printed image is a high gradation value that exceeds 85% of a total gradation range.

12. The thermal printer according to claim 11, wherein the adjustment is performed by subjecting the slope of the print density with respect to the gradation value to linear adjustment at a slope of less than 1.

13. The thermal printer according to claim 12, wherein the slope that is subjected to linear adjustment is set according to an ambient temperature, the relationship between the ambient temperature and the slope of the print density with respect to the gradation value is a positive relationship, and the slope of the print density with respect to the gradation value is set smaller as the ambient temperature becomes lower.

14. The thermal printer according to claim 11, wherein the adjustment is performed by subjecting the print density with respect to the gradation value to curve adjustment with a quadric curve having a predetermined decreasing slope characteristic.

15. The thermal printer according to claim 10, wherein the density calculator finds the average gradation value of print data for a plurality of dots selected from among the plurality of dots included in the predetermined region, a weighting coefficient is assigned to each reed shaped region in the paper feed direction on the basis of said average value, and the density evaluation value is calculated from the sum of these weighting coefficients.

16. The thermal printer according to claim 15, wherein the weighting coefficients are preset for each reed shaped region in the paper feed direction, the density calculator assigns the set weighting coefficient to the reed shaped region when, in the array of average values included in the reed shaped regions in the paper feed direction, the number of continuous selection points at which said average value exceeds a predetermined value is equal to or greater than a predetermined proportion with respect to the number of selection points included in the paper feed direction, and a weighting coefficient is assigned by giving a coefficient of 0 to said reed shaped region when the number of continuous selection points at which said average value exceeds a predetermined value does not exceed the predetermined proportion with respect to the number of selection points included in the paper feed direction.

17. The thermal printer according to claim 15 or 16, wherein the weighting coefficients are preset for each reed shaped region in the paper feed direction, and in the printing width direction, a large weighting coefficient is set for the reed shaped regions at the two ends, and a small weighting coefficient is set for the middle part sandwiched between the two ends.

18. The thermal printer according to claim 10, wherein in the multicolor printing with ink ribbons of a plurality of colors, the density evaluation value is calculated for print data of a current printing color by adding a value obtained by weighting a density evaluation value calculated for a printing color prior to the current printing color, to a value obtained by finding the average gradation value of print data for each of a plurality of dots included in the predetermined region.

19. The thermal printer according to claim 10, wherein in the continuous printing of a plurality of sheets, the density calculator calculates the density evaluation value for current print data by adding a value obtained by weighting a density evaluation value calculated for the printing prior to the current printing, to a value obtained by finding the average gradation value of print data for each of a plurality of dots included in the predetermined region.

* * * * *